US006502928B1

(12) United States Patent
Shimada et al.

(10) Patent No.: US 6,502,928 B1
(45) Date of Patent: Jan. 7, 2003

(54) INK JET RECORDING HEAD AND INK JET RECORDING APPARATUS COMPRISING THE SAME

(75) Inventors: Masato Shimada; Shinri Sakai; Yoshinao Miyata; Souichi Moriya, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/361,982

(22) Filed: Jul. 28, 1999

(30) Foreign Application Priority Data

| | | |
|---|---|---|
| Jul. 29, 1998 | (JP) | 10-214193 |
| Nov. 4, 1998 | (JP) | 10-313659 |
| Jan. 26, 1999 | (JP) | 11-017673 |
| Feb. 26, 1999 | (JP) | 11-050223 |
| Mar. 2, 1999 | (JP) | 11-054670 |
| Mar. 18, 1999 | (JP) | 11-073305 |
| Mar. 24, 1999 | (JP) | 11-079894 |
| Mar. 24, 1999 | (JP) | 11-079934 |
| Mar. 24, 1999 | (JP) | 11-079944 |
| Jul. 14, 1999 | (JP) | 11-199881 |

(51) Int. Cl.[7] ..... B41J 2/045
(52) U.S. Cl. ..... 347/68
(58) Field of Search ..... 347/70, 68, 71, 347/84–87, 92, 47, 57, 64–65

(56) References Cited

U.S. PATENT DOCUMENTS

| | | | | |
|---|---|---|---|---|
| 5,933,167 A | * | 8/1999 | Shimada et al. | 347/70 |
| 5,984,459 A | * | 11/1999 | Takahashi et al. | 347/70 |
| 6,231,169 B1 | * | 5/2001 | Yazaki et al. | 347/70 |
| 6,241,346 B1 | * | 6/2001 | Takahashi et al. | 347/70 |
| 6,113,225 A1 | * | 9/2001 | Miyata et al. | 347/70 |

FOREIGN PATENT DOCUMENTS

| | | | |
|---|---|---|---|
| EP | 0561616 A2 | 9/1993 | H01L/41/04 |
| EP | 0615294 A1 | 9/1994 | H01L/41/09 |
| EP | 0839653 A2 | 5/1998 | B41J/2/045 |
| EP | 0890440 A2 | 1/1999 | B41J/2/14 |
| JP | 5-267742 | 10/1993 | H01L/41/09 |
| JP | 5-286131 | 11/1993 | B41J/2/045 |
| JP | 8-127124 | 5/1996 | B41J/2/045 |
| JP | 9-239891 | 9/1997 | B32B/7/02 |
| JP | 9-286103 | 11/1997 | B41J/2/045 |
| JP | 10-181016 | 7/1998 | B41J/2/045 |
| JP | 10-226068 | 8/1998 | B41J/2/045 |

OTHER PUBLICATIONS

Patent Abstracts of Japan vol. 007, No. 009 (M–185), Jan. 14, 1983 & JP 57 167272 A (Hitachi Seisakusho KK), Oct. 15, 1982 Abstract.

Patent Abstracts of Japan vol. 008, No. 008 (E–221), Jan. 13, 1984 & JP 58 175314 A (Nippon Denki KK), Oct. 14, 1983 Abstract.

* cited by examiner

*Primary Examiner*—Michael Nghiem
*Assistant Examiner*—K. Feggins
(74) *Attorney, Agent, or Firm*—Sughrue Mion, PLLC

(57) ABSTRACT

An ink jet recording head includes pressure generating chambers communicating with associated nozzle orifices and piezoelectric elements provided in a one-to-one correspondence with the pressure generating chambers. Each of the piezoelectric elements includes a lower electrode provided in an area corresponding to the pressure generating chamber via an insulating layer, a piezoelectric layer provided on the lower electrode, and an upper electrode provided on a surface of the piezoelectric layer. Each of the piezoelectric elements includes an active part provided in an area facing the pressure generating chamber to be driven substantially, and an inactive part not to be driven even having the piezoelectric layer continued from the active part.

57 Claims, 28 Drawing Sheets

INK JET RECORDING HEAD AND INK JET RECORDING APPARATUS COMPRISING THE SAME

BACKGROUND OF THE INVENTION

This invention relates to an ink jet recording head wherein a piezoelectric element is formed via a diaphragm in a part of each of pressure generating chambers communicating with nozzle orifices for jetting ink drops and ink drops are jetted by displacement of the piezoelectric element, and an ink jet recording apparatus comprising the ink jet recording head.

The following two types of ink jet recording heads, each wherein a part of a pressure generating chamber communicating with a nozzle orifice for jetting an ink drop is formed of a diaphragm and the diaphragm is deformed by a piezoelectric element for pressurizing ink in the pressure generating chamber for jetting an ink drop through the nozzle orifice, are commercially practical: One uses a piezoelectric actuator in a vertical vibration mode in which the piezoelectric element is expanded and contracted axially and the other uses a piezoelectric actuator in a deflection vibration mode.

With the former, the volume of the pressure generating chamber can be changed by abutting an end face of the piezoelectric element against the diaphragm and a head appropriate for high-density printing can be manufactured, but a difficult step of dividing the piezoelectric element like comb teeth matching the arrangement pitch of the nozzle orifices and work of positioning and fixing the piezoelectric element divisions in the pressure generating chambers are required and the manufacturing process is complicated.

In contrast, with the latter, the piezoelectric element can be created and attached to the diaphragm by executing a comparatively simple process of putting a green sheet of a piezoelectric material matching the form of the pressure generating chamber and baking it, but a reasonable area is required because deflection vibration is used; high-density arrangement is difficult to make.

On the other hand, to solve the problem of the latter recording head, Japanese Patent Publication No. 5-286131A proposes an art wherein an even piezoelectric material layer is formed over the entire surface of a diaphragm according to a film formation technique and is divided to a form corresponding to a pressure generating chamber according to a lithography technique for forming a piezoelectric element separately for each pressure generating chamber.

This eliminates the need for work of putting the piezoelectric element on the diaphragm and the piezoelectric element can be created by the lithography method, an accurate and simple technique. In addition, the piezoelectric element can be thinned and high-speed drive is enabled.

In this case, with the piezoelectric material layer provided on the whole surface of the diaphragm, at least only upper electrodes are provided in a one-to-one correspondence with the pressure generating chambers, whereby the piezoelectric element corresponding to each pressure generating chamber can be driven. However, it is desirable that each active part of piezoelectric element consisting of a piezoelectric layer and upper electrode is formed so as not to be beyond the pressure generating chamber because of problems of the displacement amount per unit drive voltage and stress placed on the piezoelectric layer in the portion straddling the portion facing the pressure generating chamber and the outside thereof.

Then, a structure is proposed wherein the piezoelectric element corresponding to each pressure generating chamber is covered with an insulation layer and the insulation layer is formed with windows each for forming a connection part to a lead electrode for supplying a voltage for driving each piezoelectric element, which will be hereinafter referred to as contact holes, in a one-to-one correspondence with the pressure generating chambers, and the connection part of each piezoelectric element and lead electrode is formed in the contact hole.

However, in the structure wherein the contact holes for connecting the upper electrodes and the lead electrodes are made, the whole film of the portion where the contact hole is made becomes thick and the displacement characteristic is degraded.

With the ink jet recording head as described above, a structure wherein the diaphragm in the portion corresponding to both sides of the piezoelectric element is thinned is proposed to improve the displacement efficiency provided by drive of the piezoelectric element. However, if large displacement is thus provided, particularly the tendency of destruction of a crack, etc., to easily occur in the proximity of the contact hole is promoted.

Further, the problems easily occur particularly if a piezoelectric material layer is formed according to a film formation technique, because the piezoelectric material layer formed according to the film formation technique is very thin and thus has low rigidity as compared with a layer where a piezoelectric element is mounted.

SUMMARY OF THE INVENTION

It is therefore an object of the present invention to provide an ink jet recording head for preventing destruction of a piezoelectric layer in the boundary between a pressure generating chamber and a peripheral wall, and an ink jet recording apparatus comprising the ink jet recording head.

In order to achieve the above object, according to a first aspect of the present invention, there is provided an ink jet recording head comprising: pressure generating chambers communicating with associated nozzle orifices; and piezoelectric elements provided in a one-to-one correspondence with the pressure generating chambers, each of the piezoelectric elements comprising a lower electrode provided in an area corresponding to the pressure generating chamber via an insulating layer, a piezoelectric layer provided on the lower electrode, and an upper electrode provided on the piezoelectric layer, each active area of the piezoelectric elements provided in an area facing the pressure generating chamber, and each inactive part of the piezoelectric elements not to be driven even having the piezoelectric layer continued from the active part.

In the first aspect, when the active part of piezoelectric element is driven, displacement in the boundary between the pressure generating chamber and the peripheral wall is suppressed by the inactive part of piezoelectric element and peeling of the piezoelectric film, occurrence of a crack, and the like are prevented.

In a second aspect of the present invention, crystal directions of the piezoelectric layer are oriented.

In the second aspect, the piezoelectric layer is formed in a thin film process, so that the crystal directions are oriented.

In a third aspect of the present invention, the piezoelectric layer has a columnar crystalline structure.

In the third aspect, the piezoelectric layer is formed in a thin film process, so that piezoelectric layer has a columnar crystalline structure.

In a fourth aspect of the present invention, the inactive part is extended from the inside of the area facing the pressure generating chamber to the outside of the area.

In the fourth aspect, the upper electrode of the active part or the lead electrode can be extended to the outside of the area facing the pressure generating chamber without forming a contact hole; wiring can be formed comparatively easily.

In a fifth aspect of the present invention, in the ink jet recording head in any of the first to fourth aspects, the lower electrode is removed to form the inactive part, and either the upper electrode or a lead electrode connected thereto is extended to the top of a peripheral wall of the pressure generating chamber through the inactive part.

In a sixth aspect of the present invention, in the ink jet recording head in any of the first to fourth aspects, an end portion of the upper electrode is positioned inside from an end portion of the lower electrode to be an end portion of the active part. The piezoelectric layer is provided on the lower electrode projecting to the outside from the end portion of the upper electrode, forming the inactive part, and is also provided outside the end portion of the lower electrode.

In the sixth aspect, a distance can be kept between the end portion of the active part and the end portion of the upper electrode, and a dielectric breakdown caused by concentration of an electric field, etc., at the end portion in the longitudinal direction of the active part is prevented.

In a seventh aspect of the present invention, in the ink jet recording head in any of the first to sixth aspects, the inactive part of piezoelectric element is provided continuously at one end portion in the longitudinal direction of the active part of piezoelectric element.

In the seventh aspect, peeling, occurrence of a crack, and the like at the end portion in the longitudinal direction of the active part of piezoelectric element are prevented.

In an eighth aspect of the present invention, in the ink jet recording head in the seventh aspect, the width of the inactive part at least in the proximity of a portion crossing the boundary between an end portion and the peripheral wall of the pressure generating chamber is narrower than the width of the active part.

In the eighth aspect, the displacement characteristic in the area facing the boundary between the pressure generating chamber and its peripheral wall is enhanced.

In a ninth aspect of the present invention, in the ink jet recording head in the seventh aspect, the width of the inactive part at least in the proximity of a portion crossing the boundary between an end portion and the peripheral wall of the pressure generating chamber is wider than the width of the pressure generating chamber.

In the ninth aspect, the rigidity of a diaphragm in the proximity of the end portion of the pressure generating chamber is held high and destruction of the diaphragm by driving the active part is prevented.

In a tenth aspect of the present invention, in the ink jet recording head in any of the first to ninth aspects, a displacement suppression layer for suppressing displacement of the active part is provided in an area facing the boundary between the active part and the inactive part.

In the tenth aspect, displacement of the active part at the end portion thereof is suppressed and destruction of the diaphragm by driving the active part is prevented.

In an eleventh aspect of the present invention, in the ink jet recording head in any of the first to tenth aspects, the lower electrode is provided continuously to the area facing partitions on both sides in the width direction of the pressure generating chamber and adjacent pressure generating chambers.

In the eleventh aspect, the rigidity of the diaphragm at both end portions in the width direction of the pressure generating chamber is held high and the durability of the diaphragm is enhanced.

In a twelfth aspect of the present invention, in the ink jet recording head in any of the first to tenth aspects, the inactive part is provided in one longitudinal end portion of the piezoelectric element. The lower electrode is provided so that both end portions in the width direction of the lower electrode are positioned in the pressure generating chamber together with both end portions in the width direction of the piezoelectric layer, and is extended from the other longitudinal end portion of the piezoelectric element to the top of the peripheral wall of the pressure generating chamber.

In the twelfth aspect, a distance can be kept between the end portion of the active part and the end portion of the upper electrode, and a dielectric breakdown caused by concentration of an electric field, etc., at the end portion in the longitudinal direction of the active part is prevented.

In a thirteenth aspect of the present invention, in the ink jet recording head in any of the first to eleventh aspects, the area facing the pressure generating chamber other than the inactive part is covered with the lower electrode.

In the thirteenth aspect, the end portion of the lower electrode does not exist in the surroundings of the lower electrode patterned in the pressure generating chamber, thus discharge is hard to occur and a dielectric breakdown of the piezoelectric layer is prevented.

In a fourteenth aspect of the present invention, in the ink jet recording head in any of the fifth to thirteenth aspects, the width of the removed lower electrode below the inactive part is narrower than the width of the pressure generating chamber.

In the fourteenth aspect, a dielectric breakdown of the piezoelectric layer is prevented without degrading the rigidity in the proximity of the end portion of the pressure generating chamber.

In a fifteenth aspect of the present invention, in the ink jet recording head in the thirteenth aspect, the inactive part is extended from a substantially central part of the pressure generating chamber in the longitudinal direction thereof on one peripheral wall in the width direction of the pressure generating chamber.

In the fifteenth aspect, a voltage can be applied to the central part in the longitudinal direction of the active part and the drive loss of the active part is suppressed.

In a sixteenth aspect of the present invention, in the ink jet recording head in any of the thirteenth to fifteenth aspects, the removed portion of the lower electrode below the inactive part is shaped substantially into a circle.

In the sixteenth aspect, the electric field applied to the part between the upper electrode and the lower electrode in the boundary between the end portion and peripheral wall of the pressure generating chamber is dispersed more widely and a dielectric breakdown of the piezoelectric layer is prevented.

In a seventeenth aspect of the present invention, in the ink jet recording head in any of the thirteenth to sixteenth aspects, the direction in which a margin of the upper electrode crosses from the top of the lower electrode to the top of the lower electrode removed portion is different from the direction in which the upper electrode is extended to the top of the peripheral wall of the pressure generating chamber.

In the seventeenth aspect, the electric field applied to the part between the upper electrode and the lower electrode in the boundary between the end portion and peripheral wall of the pressure generating chamber is dispersed reliably and a dielectric breakdown of the piezoelectric layer is prevented reliably.

In an eighteenth aspect of the present invention, in the ink jet recording head in any of the first to seventeenth aspects, the width of the lower electrode in a portion facing the boundary of the active part and the inactive part is narrower than any other portion.

In the eighteenth aspect, a dielectric breakdown between electrodes in the portion where the piezoelectric layer and the upper electrode are extended from the inside of the area of the pressure generating chamber to the outside of the area.

In a nineteenth aspect of the present invention, in the ink jet recording head in the eighteenth aspect, at least the distal end of the narrowed portion of the lower electrode is narrower than the piezoelectric layer and the upper electrode of the inactive part.

In the nineteenth aspect, at least the distal end of the narrowed portion is covered with the piezoelectric layer and insulated from the upper electrode reliably.

In a twentieth aspect of the present invention, in the ink jet recording head in the eighteenth aspect, the whole of the narrowed portion of the lower electrode is narrower than the piezoelectric layer and the upper electrode of the inactive part.

In the twentieth aspect, the whole narrowed portion is covered with the piezoelectric layer and the narrowed portion of the lower electrode and the upper electrode are insulated reliably.

In a twenty-first aspect of the present invention, in the ink jet recording head in the eighteenth aspect, the width of the narrowed portion of the lower electrode is wider than that of the piezoelectric layer and the upper electrode of the inactive part. The distance between an end face in the width direction of the narrowed portion and an end face in the width direction of the upper electrode is about 10 $\mu$m or less.

In the twenty-first aspect, a predetermined or shorter distance is kept between the lower electrode and the upper electrode, whereby discharge between both the electrodes is prevented.

In a twenty-second aspect of the present invention, in the ink jet recording head in any of the fifth to twenty-first aspects, a discontinuous lower electrode discontinuous with the lower electrode is provided below the piezoelectric layer in the area facing the boundary between the pressure generating chamber and the peripheral wall thereof.

In the twenty-second aspect, the rigidity of the diaphragm in the portion where the piezoelectric layer and the upper electrode are drawn to the area outside the pressure generating chamber is held high and destruction of the diaphragm and the piezoelectric layer in the portion is prevented.

In a twenty-third aspect of the present invention, in the ink jet recording head in the twenty-second aspect, the discontinuous lower electrode is provided covering at least a margin of the pressure generating chamber.

In the twenty-third aspect, the rigidity of the diaphragm in the proximity of the end portion of the pressure generating chamber is held high and the durability is enhanced.

In a twenty-fourth aspect of the present invention, in the ink jet recording head in the twenty-second or twenty-third aspect, the discontinuous lower electrode is made discontinuous with the lower electrode by removing a lower electrode in the proximity of the end portion of the lower electrode in the longitudinal direction of the pressure generating chamber so as to extend in a width direction of the pressure generating chamber.

In the twenty-fourth aspect, the spacing between the discontinuous lower electrode and the lower electrode can be made narrow and the rigidity of the diaphragm is held higher.

In a twenty-fifth aspect of the present invention, in the ink jet recording head in any of the twenty-second to twenty-fourth aspects, the discontinuous lower electrode is not electrically connected to any parts.

In the twenty-fifth aspect, the discontinuous lower electrode and the lower electrode are insulated reliably.

In a twenty-sixth aspect of the present invention, in the ink jet recording head in any of the twenty-second to twenty-fourth aspects, the discontinuous lower electrode is connected to a resistor so that time constant of the lower electrode becomes larger than that of a drive pulse for the piezoelectric element.

In the twenty-sixth aspect the discontinuous lower electrode and the lower electrode are insulated reliably and the discontinuous lower electrode is prevented from having an excessive potential.

In a twenty-seventh aspect of the present invention, in the ink jet recording head in any of the twenty-second to twenty-sixth aspects, a wiring lower electrode is provided for each piezoelectric element on the peripheral wall on which the discontinuous lower electrode is provided discretely from the discontinuous lower electrode.

In the twenty-seventh aspect, wiring can be drawn from the active part easily and efficiently.

In a twenty-eighth aspect of the present invention, in the ink jet recording head in any of the twenty-second to twenty-fourth aspects, the discontinuous lower electrode is separated for each active part in the width direction of the pressure generating chamber and each is connected to either the upper electrode of the corresponding active part or a lead electrode connected to the top of the upper electrode.

In the twenty-eighth aspect, the rigidity of the diaphragm in the portion where the piezoelectric layer and the upper electrode are drawn to the area outside the pressure generating chamber is held high and wiring can be drawn efficiently.

In a twenty-ninth aspect of the present invention, in the ink jet recording head in the twenty-eighth aspect, each discontinuous lower electrode and the lower electrode have a spacing to such an extent that they can be insulated from each other.

In the twenty-ninth aspect, each active part of piezoelectric element is driven reliably and the jet characteristic is held good.

In a thirtieth aspect of the present invention, in the ink jet recording head in the twenty-eighth or twenty-ninth aspect, an intermediate electrode having no connection with any parts is provided between the juxtaposed discontinuous lower electrodes.

In the thirtieth aspect, removal of the lower electrode can be minimized and the rigidity of the diaphragm can be held more reliably.

In a thirty-first aspect of the present invention, in the ink jet recording head in any of the twenty-second to thirtieth aspects, the piezoelectric layer is left at least in a part of the removed portion of the lower electrode situated in other than the area corresponding to the piezoelectric element.

In the thirty-first aspect, the discontinuous removed portion and the lower electrode are insulated reliably and reliability can be enhanced.

In a thirty-second aspect of the present invention, in the ink jet recording head in any of the first to thirty-first aspects, a remaining part made of the same layer as the lower electrode is provided on the partition on both sides of the pressure generating chamber in the width direction thereof.

In the thirty-second aspect, the lower electrode removal area lessens, thus the piezoelectric layer is formed in a substantially even film thickness on the lower electrode patterned.

In a thirty-third aspect of the present invention, in the ink jet recording head in the thirty-second aspect, outside the end portion of the lower electrode of the active part, a discontinuous lower electrode discontinuous with the lower electrode. The remaining part is extended continuously from the discontinuous lower electrode.

In the thirty-third aspect, the spacing between the lower electrode forming a part of the piezoelectric element and the remaining part can be made narrow and the piezoelectric layer is formed in a even film thickness more reliably.

In a thirty-fourth aspect of the present invention, in the ink jet recording head in the thirty-second aspect, the remaining part is provided continuously with the lower electrode forming a part of the piezoelectric element.

In the thirty-fourth aspect, the spacing between the lower electrode forming a part of the piezoelectric element and the remaining part can be made narrow and the piezoelectric layer is formed in a even film thickness.

In a thirty-fifth aspect of the present invention, in the ink jet recording head in any of the thirty-second to thirty-fourth aspects, spacing between an end face in the width direction of the lower electrode and an end face in the width direction of the remaining part is wider than the thickness of the piezoelectric layer and is narrower than the width of the lower electrode.

In the thirty-fifth aspect, the film thickness of the piezoelectric layer in the width direction thereof becomes substantially even and the piezoelectric characteristic is not degraded.

In a thirty-sixth aspect of the present invention, in the ink jet recording head in any of the thirty-second to thirty-fifth aspects, an longitudinal end portion of the piezoelectric layer is situated in the proximity of the end portion of the pressure generating chamber the side of which the lower electrode is extended to the top of the peripheral wall. The distance from that end portion to a part where the lower electrode extended to the outside becomes wider is wider than the thickness of the piezoelectric layer and is narrower than the width of the lower electrode.

In the thirty-sixth aspect, the film thickness of the piezoelectric layer in the proximity of the end portion in the longitudinal direction of the pressure generating chamber becomes even and if the piezoelectric layer is patterned, the lower electrode therebelow does not become thin.

In a thirty-seventh aspect of the present invention, in the ink jet recording head in any of the thirty-second to thirty-sixth aspects, the remaining part has a width which is 50% or more of the width of the partition between the adjacent pressure generating chambers.

In the thirty-seventh aspect, the remaining part is formed in a predetermined width, whereby the piezoelectric layer is formed in a even film thickness more reliably.

In a thirty-eighth aspect of the present invention, in the ink jet recording head in any of the thirty-second to thirty-seventh aspects, the lower electrode and the remaining part are formed in an area having a width of 50% or more of the area corresponding to the pressure generating chambers placed side by side and the partitions on both sides of the pressure generating chambers in the width direction thereof.

In the thirty-eighth aspect, the lower electrode and the remaining part are set to predetermined dimensions, whereby the film thickness of the piezoelectric layer becomes even reliably.

In a thirty-ninth aspect of the present invention, in the ink jet recording head in any of the thirty-second to thirty-eighth aspects, the lower electrode and the remaining part are formed in an area of 50% or more of all area of the channel substrate.

In the thirty-ninth aspect, the lower electrode and the remaining part are set to predetermined dimensions, whereby the film thickness of the piezoelectric layer becomes even reliably.

In a fortieth aspect of the present invention, in the ink jet recording head in any of the first to thirty-ninth aspects, the crystalline structure of the piezoelectric layer on the lower electrode is the same as that on the insulating layer.

In the fortieth aspect, the crystalline state of the piezoelectric layer formed on the insulating layer becomes the same as that of the piezoelectric layer formed on the lower electrode, so that cracks do not occur and an abnormal stress does not occur on pattern boundaries either.

In a forty-first aspect of the present invention, in the ink jet recording head in the fortieth aspect, crystal seeds becoming nuclei of crystal of the piezoelectric layer are formed on a surface of the insulating layer.

In the forty-first aspect, the crystal structure of the piezoelectric layer is aligned in one orientation and is substantially evenly formed owing to the crystal seeds and occurrence of cracks, etc., is prevented.

In a forty-second aspect of the present invention, in the ink jet recording head in the fortieth aspect, the crystal seeds are formed like islands.

In the forty-second aspect, the crystal of the piezoelectric layer is grown from the crystal seed formed like islands.

In a forty-third aspect of the present invention, in the ink jet recording head in any of the fifth to forty-second aspects, a second insulating layer is provided on the outside of the end portion of the lower electrode.

In the forty-third aspect, the piezoelectric layer does not become thin in the proximity of the end of the lower electrode and a dielectric breakdown of the piezoelectric layer caused by concentration of an electric field is prevented.

In a forty-fourth aspect of the present invention, in the ink jet recording head in the forty-third aspect, the second insulating layer has substantially the same film thickness as the lower electrode.

In the forty-fourth aspect, the level difference between the lower electrode and the second insulating layer is small and the piezoelectric layer of a substantially even film thickness can be formed thereon.

In a forty-fifth aspect of the present invention, in the ink jet recording head in the forty-third or forty-fourth aspect, the second insulating layer is made of an insulating material different from that of the insulating layer.

In the forty-fifth aspect, the second insulating layer delivers a function regardless of the type of insulating material.

In a forty-sixth aspect of the present invention, in the ink jet recording head in any of the fifth to forty-second aspects, the insulating layer includes a thick portion situated on the outside of the end portion of the lower electrode.

In the forty-sixth aspect, the piezoelectric layer does not become thin in the proximity of the end portion of the lower electrode, so that a dielectric breakdown of the piezoelectric layer caused by concentration of an electric field can be prevented.

In a forty-seventh aspect of the present invention, in the ink jet recording head in the forty-sixth aspect, the thick portion has substantially the same thickness as the lower electrode.

In the forty-seventh aspect, the level difference between the lower electrode and the thick portion is small and the piezoelectric layer of a substantially even film thickness can be formed thereon.

In a forty-eighth aspect of the present invention, in the ink jet recording head in any of the fifth to forty-second aspects, a tapering portion where film thickness of the lower electrode is gradually decreased toward the outside of the active part is provided at the end portion of the lower electrode.

In the forty-eighth aspect, the tapering portion is provided at the end portion of the lower electrode, thus the piezoelectric layer formed in the proximity of the end portion of the lower electrode does not become thin and a dielectric breakdown in the proximity of the end portion of the active part is prevented.

In a forty-ninth aspect of the present invention, in the ink jet recording head in the forty-eighth aspect, the tapering portion forms a slope where the film thickness of the lower electrode is gradually decreased.

In the forty-ninth aspect, the piezoelectric layer is formed along the slope of the tapering portion and the piezoelectric layer at the end of the active part does not become thin.

In a fiftieth aspect of the present invention, in the ink jet recording head in the forty-eighth aspect, the tapering portion is a part where the film thickness of the lower electrode is gradually decreased stepwise.

In the fiftieth aspect, the piezoelectric layer is formed along the form of the tapering portion and becomes substantially the same film thickness as any other portion.

In a fifty-first aspect of the present invention, in the ink jet recording head in the forty-eighth aspect, the tapering portion forms a slanting curved surface where the film thickness of the lower electrode is gradually decreased continuously.

In the fifty-first aspect, the piezoelectric layer is formed along the form of the tapering portion and becomes substantially the same film thickness as any other portion.

In a fifty-second aspect of the present invention, in the ink jet recording head in any of the forty-eighth to fifty-first aspects, the piezoelectric layer formed on the tapering portion is thicker than any other portion.

In the fifty-second aspect, concentration of an electric field, etc., on the piezoelectric layer in the proximity of the end portion of the active part does not occur and a dielectric breakdown is prevented.

In a fifty-third aspect of the present invention, in the ink jet recording head in any of the fifth to fifty-second aspects, both longitudinal end portions of the active part are formed into a similar structure.

In the fifty-third aspect, like the one end portion of the active part, the opposite end portion is also prevented from being destroyed.

In a fifty-fourth aspect of the present invention, in the ink jet recording head in any of the fifth to fifty-second aspects, end portions of the piezoelectric layer and the upper electrode define a distal end of the active part which is opposed end to the end continued to the inactive part. In the distal end is covered with a discontinuous piezoelectric layer discontinuous with the piezoelectric layer.

In the fifty-fourth aspect, the end portion of the active part is protected by the discontinuous piezoelectric layer and the piezoelectric layer and the upper electrode are prevented from peeling, etc.

In a fifty-fifth aspect of the present invention, in the ink jet recording head in any of the fifth to fifty-second aspects, end portions of the piezoelectric layer and the upper electrode define a distal end of the active part which is opposed end to the end continued to the inactive part. The distal end is fixed with an adhesive.

In the fifty-fifth aspect, the end of the active part of piezoelectric element is fixed and the piezoelectric layer and the upper electrode are prevented from peeling, etc.

In a fifty-sixth aspect of the present invention, in the ink jet recording head in any of the first to fifty-fifth aspects, the pressure generating chambers are formed in a silicon monocrystalline substrate by anisotropic etching. The lower electrode, piezoelectric, and upper electrode layers are formed by film formation and lithography method.

In the fifty-sixth aspect, ink jet recording heads each having high-density nozzle orifices can be manufactured in large quantities and comparatively easily.

According to a fifty-seventh aspect of the present invention, there is provided an ink jet recording apparatus comprising an ink jet recording head in any of first to fifty-sixth aspects.

In the fifty-seventh aspect, an ink jet recording apparatus improved in the head reliability can be provided.

DETAILED DESCRIPTION OF THE PREFERRED EMBODIMENTS

Referring now to the accompanying drawings, there are shown preferred embodiments of the present invention.

Figure 1:
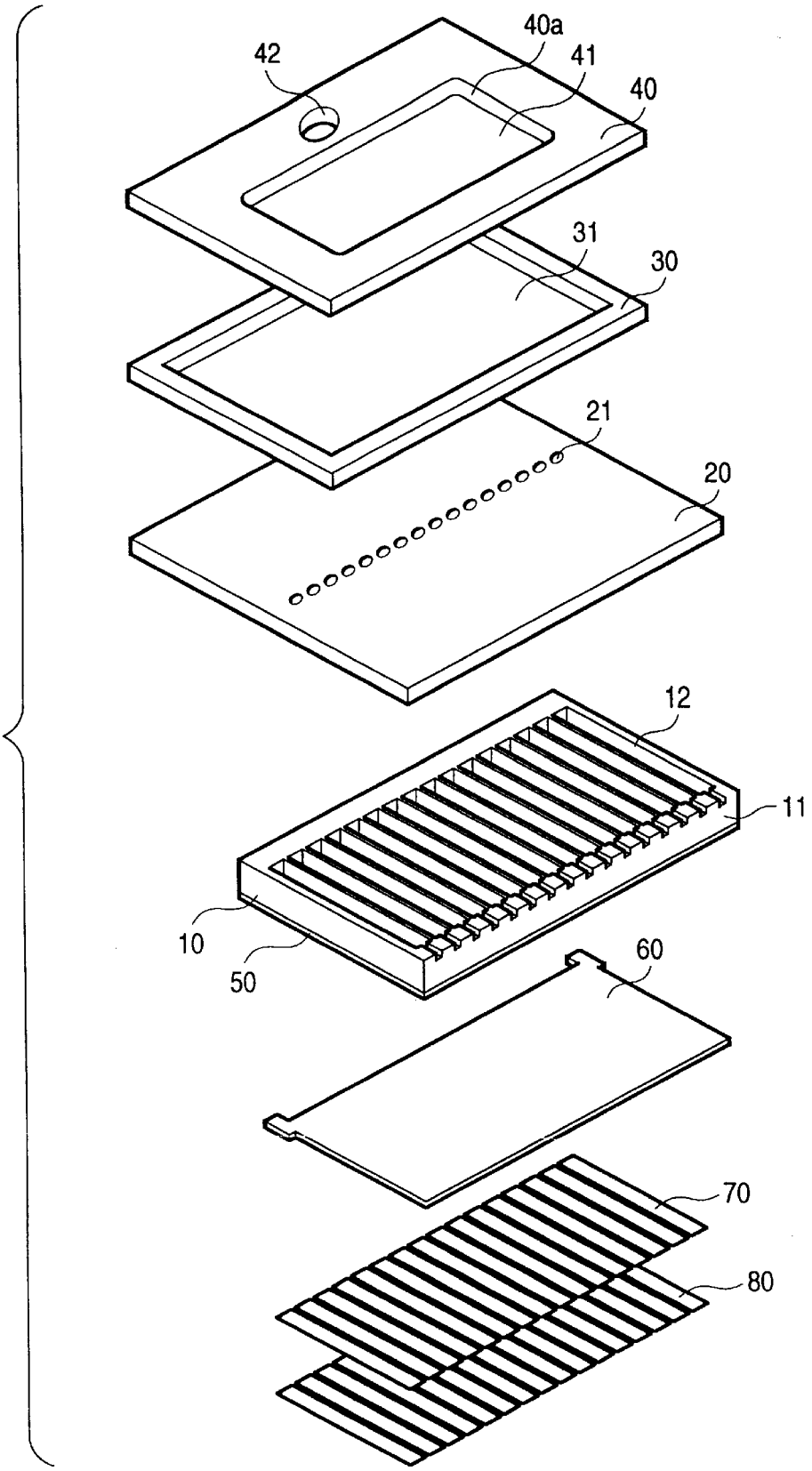
FIG. 1 is an exploded perspective view of an ink jet recording head according to a first embodiment of the present invention.
Figure 2A:
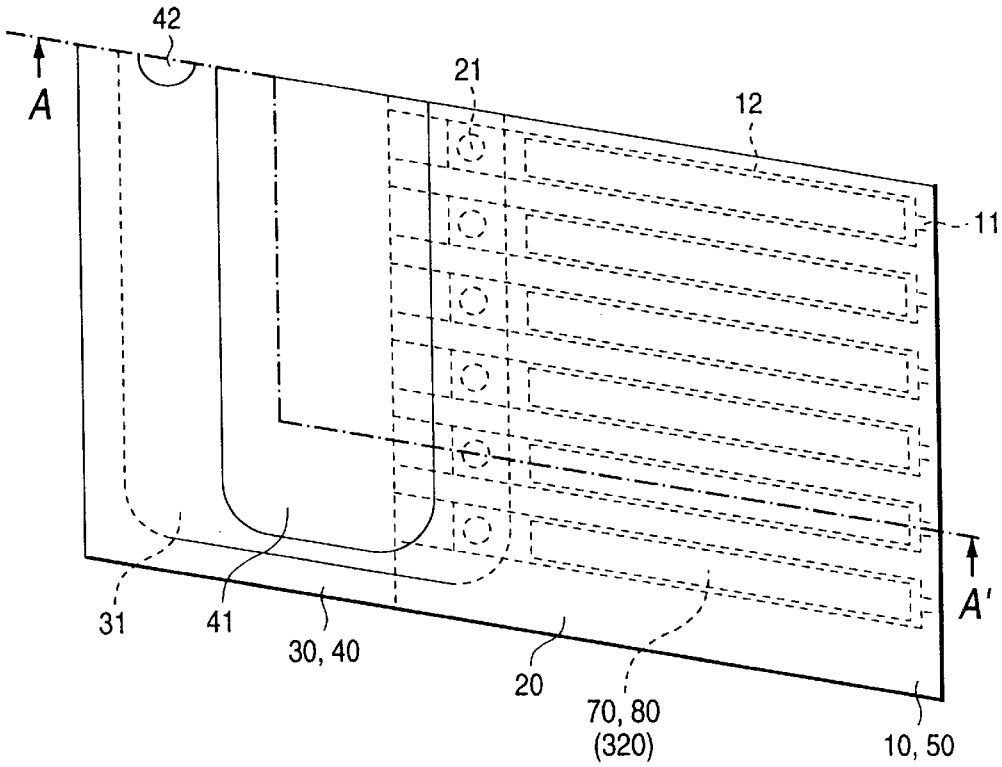
FIGS. 2A and 2B are a plan view and a sectional view of the ink jet recording head shown in FIG. 1 according to the first embodiment of the present invention.
Figure 2B:
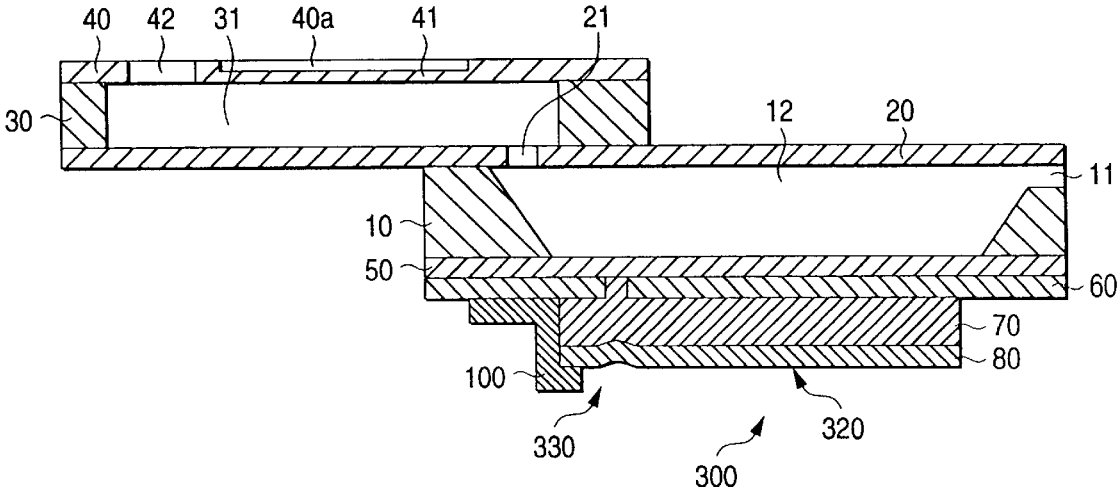

FIG. 1 is an exploded perspective view to show an ink jet recording head according to a first embodiment of the present invention. FIG. 2A is a plan view of the ink jet recording head shown in FIG. 1 and FIG. 2B is a sectional view to show the sectional structure in a longitudinal direction of one pressure generating chamber.

A channel substrate 10 is made of a silicon monocrystalline substrate having <110> direction of the crystal surface orientation in the embodiment. Normally, a substrate about 150–300 $\mu$m thick is used as the channel substrate 10; preferably a substrate about 180–280 $\mu$m thick, more preferably a substrate about 220 $\mu$m thick is used because the arrangement density can be made high while the rigidity of a partition between contiguous pressure generating chambers is maintained.

The channel substrate 10 is formed on one face with an opening face and on an opposite face with an elastic film 50 of 0.1–2 $\mu$m thick made of silicon dioxide previously formed by thermal oxidation.

On the other hand, the channel substrate 10 is formed on the opening face with nozzle orifices 11 and pressure generating chambers 12 by anisotropically etching the silicon monocrystalline substrate.

The anisotropic etching is executed by using the nature that if the silicon monocrystalline substrate is immersed in an alkaline solution such as KOH, it gradually erodes, a first <111> plane perpendicular to a <110> plane and a second <111> plane forming about 70 degrees with the first <111> plane and forming about 35 degrees with the <110> plane appear, and the etching rate of the <111> plane is about 1/180 that of the <110> plane. By the anisotropic etching, accurate work can be executed based on depth work like a parallelogram formed by the two first <111> planes and the two second <111> planes tilted, and the pressure generating chambers 12 can be arranged at a high density.

In the embodiment, the long sides of each pressure generating chamber 12 are formed by the first <111> planes and the short sides are formed by the second <111> planes. The pressure generating chambers 12 are formed by etching the silicon monocrystalline substrate to the elastic film 50. The amount of immersing the elastic film 50 in the alkaline solution for etching the silicon monocrystalline substrate is extremely small.

On the other hand, each nozzle orifice 11 communicating with one end of each pressure generating chambers 12 is formed narrower and shallower than the pressure generating chamber 12. That is, the nozzle orifices 11 are made by etching the silicon monocrystalline substrate to an intermediate point in the thickness direction (half etching). The half etching is executed by adjusting the etching time.

The size of each pressure generating chamber 12 for giving ink drop jet pressure to ink and the size of each nozzle orifice 11 for jetting ink drops are optimized in response to the jetted ink drop amount, jet speed, and jet frequency. For example, to record 360 ink drops per inch, the nozzle orifice 11 needs to be made with accuracy with a groove width of several ten $\mu$m.

The pressure generating chambers 12 and an ink reservoir 31 (described later) are made to communicate with each other via ink supply ports 21 formed at positions of a sealing plate 20 (described later) corresponding to one end of the each pressure generating chamber 12. Ink is supplied from the ink reservoir 31 through the ink supply ports 21 to the pressure generating chambers 12.

Figure 3A:
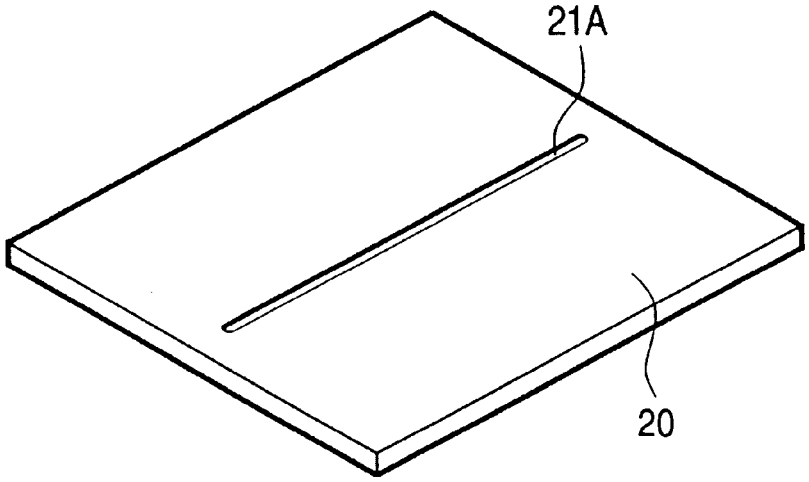
FIGS. 3A and 3B are perspective views to show modified examples of a sealing plate shown in FIG. 1.
Figure 3B:
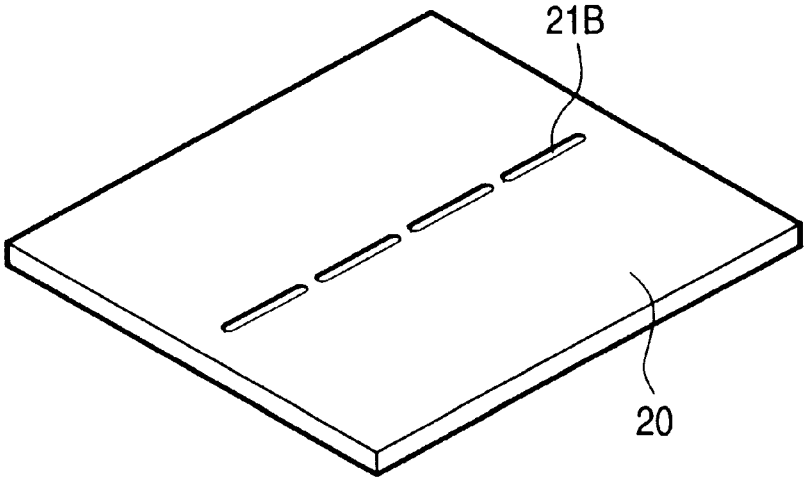

The sealing plate 20 is made of glass ceramic having a thickness of 0.1–1 mm and a linear expansion coefficient of $2.5–4.5\times10^{-6}$ [/°C] at 300° C. or less, for example, formed with the ink supply ports 21 corresponding to the pressure generating chambers 12. The ink supply ports 21 may be one slit hole 21A or a plurality of slit holes 21B crossing the neighborhood of the ink supply side ends of the pressure generating chambers 12 as shown in FIG. 3A or 3B. One face of the sealing plate 20 fully covers one face of the channel substrate 10, namely, the sealing plate 20 also serves as a reinforcing plate for protecting the silicon monocrystalline substrate from shock and external force. An opposite face of the sealing plate 20 forms one wall face of the ink reservoir 31.

A ink reservoir substrate 30 forms a peripheral wall of the ink reservoir 31; it is made by stamping a stainless steel having a proper thickness responsive to the number of nozzle orifices and the ink drop jet frequency. In the embodiment, the ink reservoir substrate 30 is 0.2 mm thick.

An ink reservoir side plate 40 is made of a stainless substrate and one face thereof forms one wall face of the ink reservoir 31. The ink reservoir side plate 40 is formed with a thin wall 41 by forming a recess 40*a* by half etching a part of an opposite face, and is punched to make an ink introduction port 42 for receiving ink supply from the outside. The thin wall 41 is adapted to absorb pressure toward the opposite side to the nozzle orifices 11 occurring when ink drops are jetted; it prevents unnecessary positive or negative pressure from being applied to another pressure generating chamber 12 via the ink reservoir 31. In the embodiment, considering the rigidity required at the connection time of the ink introduction port 42 and an external ink supplier, etc., the ink reservoir side plate 40 is 0.2 mm thick and a part thereof is made the thin wall 41 of 0.02 mm thick. However, to skip formation of the thin wall 41 by half etching, the ink reservoir side plate 40 may be made 0.02 mm thick from the beginning.

On the other hand, a lower electrode film 60, for example, about 0.5 $\mu$m thick, a piezoelectric film 70, for example, about 1 $\mu$m thick, and an upper electrode film 80, for example, about 0.1 $\mu$m thick are deposited on the elastic film 50 on the opposite side to the opening face of the channel substrate 10 by a process described later, making up a piezoelectric element 300. This piezoelectric element 300 refers to the portion containing the lower electrode film 60, the piezoelectric film 70, and the upper electrode film 80. Generally, one electrode of the piezoelectric element 300 is used as a common electrode and the other electrode and the piezoelectric film 70 are patterned for each pressure generating chamber 12. A portion made up of the electrode and the piezoelectric film 70 patterned where piezoelectric distortion occurs as voltage is applied to both electrodes is referred to as an active part of piezoelectric element 320. In the embodiment, the lower electrode film 60 is used as the common electrode of the piezoelectric element 300 and the upper electrode film 80 is used as a discrete electrode of the piezoelectric element 300, but the lower electrode film 60 may be used as a discrete electrode and the upper electrode film 80 may be used as the common electrode for convenience of a drive circuit and wiring. In any case, the active part of piezoelectric element is formed for each pressure generating chamber 12. Here, the piezoelectric element 300 and the diaphragm displaced by drive of the piezoelectric element 300 are collectively called a piezoelectric actuator.

A process of forming the piezoelectric films 70, etc., on the channel substrate 10 made of a silicon monocrystalline substrate will be discussed with reference to FIGS. 4 to 6. FIGS. 4 and 6 are sectional views in the width direction of the pressure generating chambers 12 and FIG. 5 is a sectional view in the longitudinal direction of the pressure generating chamber 12.

Figure 4A:
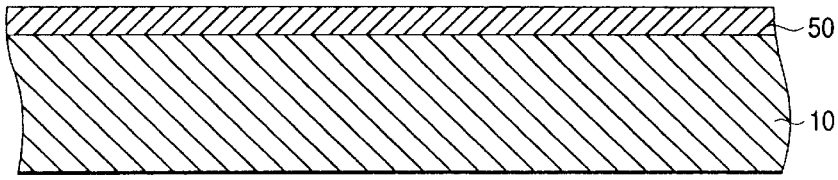
FIGS. 4A to 4E are sectional views to show a thin film manufacturing process in the first embodiment of the present invention.

As shown in FIG. 4A, first a wafer of a silicon monocrystalline substrate of which the channel substrate 10 will be made is thermally oxidized in a diffusion furnace at about 1100° C. to form the elastic film 50 made of silicon dioxide.

Figure 4B:
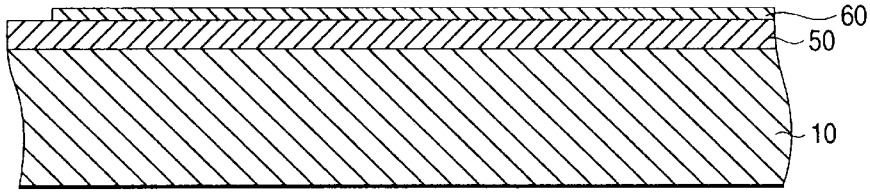

Next, as shown in FIG. 4B, the lower electrode film 60 is formed by sputtering. Platinum, etc, is preferred as a material of the lower electrode film 60, because the piezoelectric film 70 (described later) formed by a sputtering method or a sol-gel method needs to be baked and crystallized at a temperature of about 600° C.–1000° C. in an atmosphere or an oxygen atmosphere after film formation. That is, the material of the lower electrode film 60 must be able to hold electrical conductivity in such a high-temperature, oxygen atmosphere. Particularly if lead zirconate titanate (PZT) is used as the piezoelectric film 70, it is desired that change in electrical conductivity caused by diffusion of lead oxide (plumbous oxide) is less; platinum is preferred for the reasons.

Figure 4C:
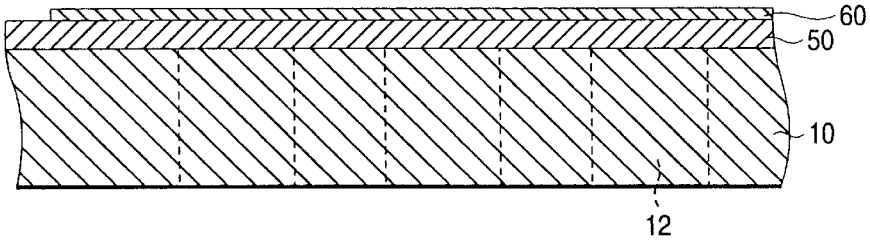
Figure 5:
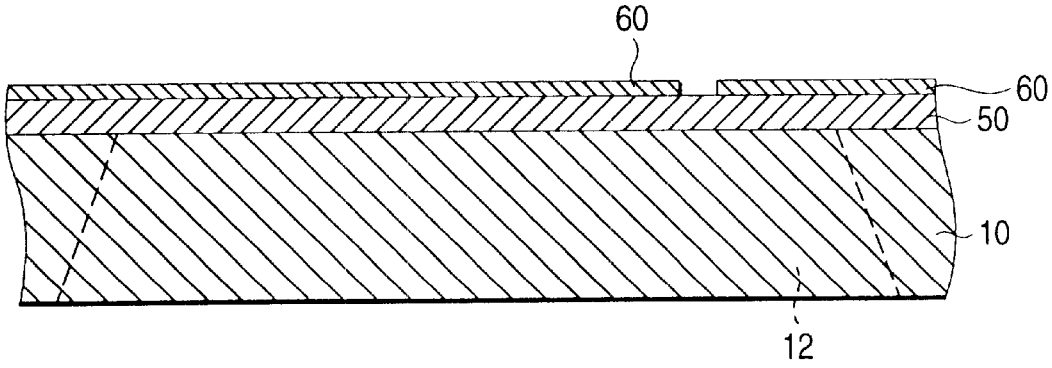
FIG. 5 is a sectional view to show the thin film manufacturing process in the first embodiment of the present invention.

Next, as shown in FIGS. 4C and 5, the lower electrode film 60 is patterned to form a whole pattern and wiring lower electrode films 61 extended from the area facing the pressure generating chamber 12 to the top of the peripheral wall are formed in the area facing the proximity of one end portion in the longitudinal direction for each pressure generating chamber 12.

Figure 4D:
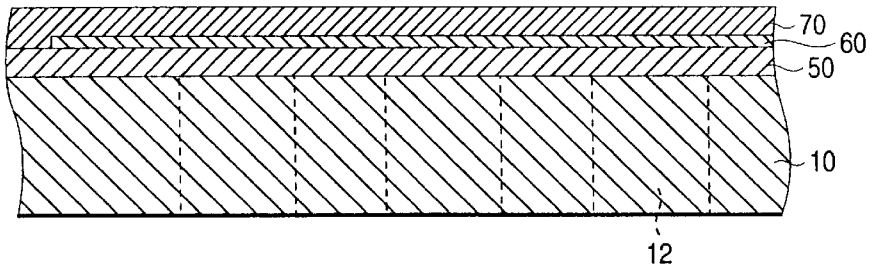

Next, as shown in FIG. 4D, the piezoelectric film 70 is formed. Preferably, crystals of the piezoelectric film 70 are oriented. For example, in the embodiment, to form the piezoelectric film 70, a so-called sol-gel method is used wherein so-called sol comprising metal organic substance dissolved and dispersed in a solvent is applied and dried to gel and further the gel is baked at a high temperature, thereby providing the piezoelectric film 70 having crystal oriented. A lead zirconate titanate family material is preferred as a material of the piezoelectric film 70 for use with an ink jet recording head. The formation method of the piezoelectric film 70 is not limited; for example, the piezoelectric film 70 may be formed by the sputtering method.

Further, after a precursor film of lead zirconate titanate is formed by the sol-gel method, the sputtering method, or the like, it may be crystal-grown at a low temperature by a high-pressure processing method in an alkaline solution.

In any case, in the piezoelectric film 70 manufactured thereby, crystal direction thereof is preferentially oriented differently from piezoelectric bulk, and the crystal has a columnar structure. Here, "preferential orientation" means a state wherein oriented direction of the crystal is not in disorder but specific crystal faces are almost oriented in a definite direction. And "columnar crystal structure" means a state wherein cylindrical crystals are gathering in a surface direction thereof to form a thin film while central axes thereof are substantially coincident with each other in a thickness direction thereof. Of course, the thin film may be composed with preferentially oriented granular crystals. The thickness of the piezoelectric film manufactured by such thin film technique is 0.5–5 $\mu$m in general.

Figure 4E:
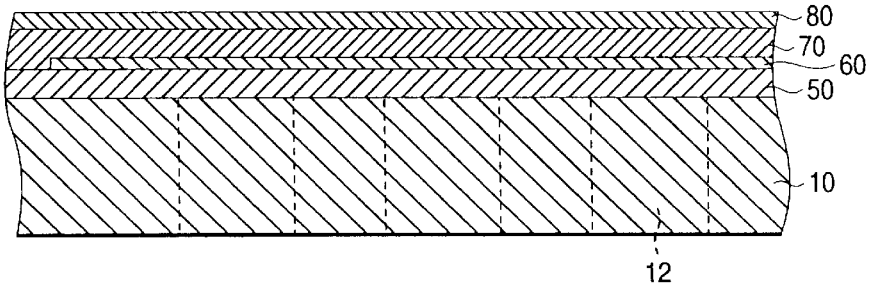

Next, as shown in FIG. 4E, the upper electrode film 80 is formed. The upper electrode film 80 may be made of any material if it has high electrical conductivity; metal of aluminum, gold, nickel, platinum, etc., conductive oxide, etc., can be used. In the embodiment, the upper electrode film 80 is formed of platinum by the sputtering method.

Figure 6A:
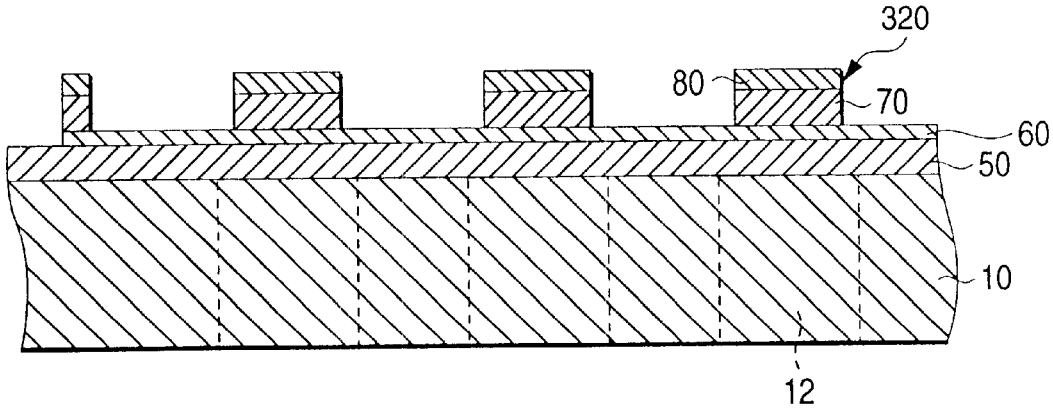
FIGS. 6A and 6B are sectional views to show the thin film manufacturing process in the first embodiment of the present invention.
Figure 6B:
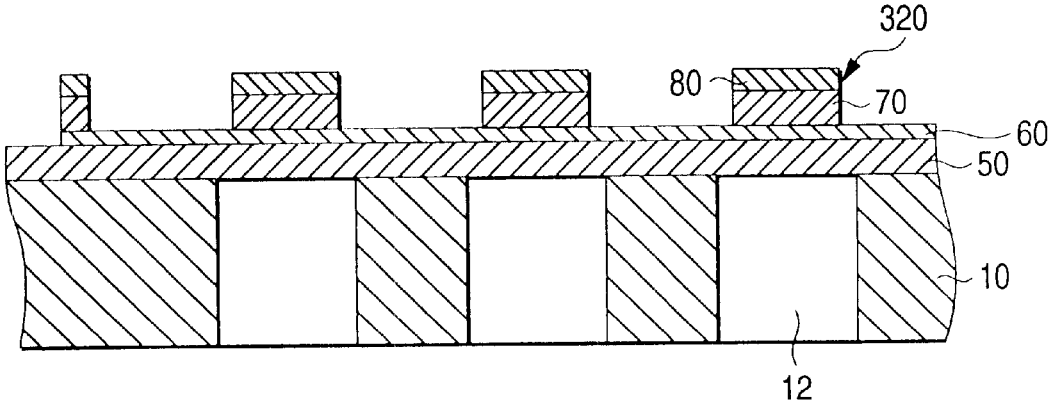

Then, as shown in FIG. 6A, only the piezoelectric film 70 and the upper electrode film 80 are etched for patterning the active part of piezoelectric elements 320. The film formation process is now complete. After film formation is thus executed, anisotropic etching of the silicon monocrystalline substrate in alkaline solution described above is executed to form the pressure generating chambers 12, etc., as shown in FIG. 6B.

Figure 7A:
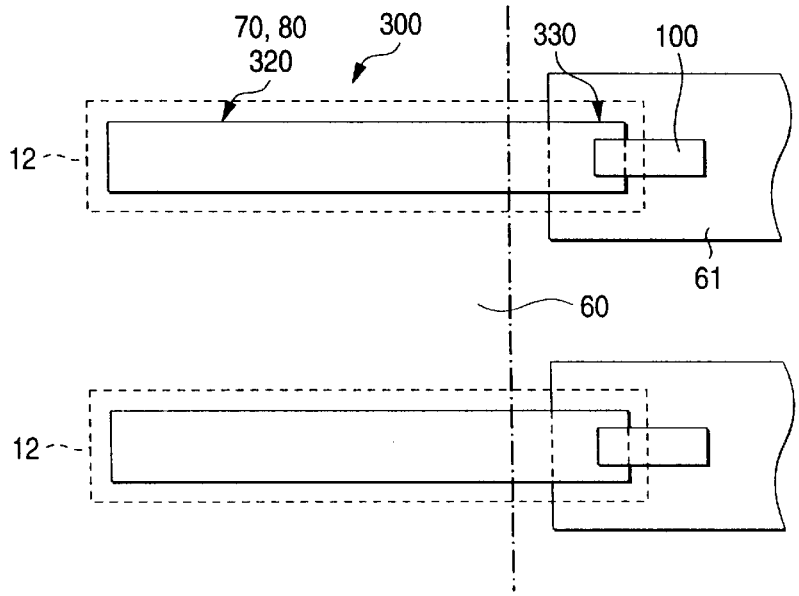
FIGS. 7A and 7B are a plan view and a sectional view to show the main part of the ink jet recording head according to the first embodiment of the present invention.
Figure 7B:
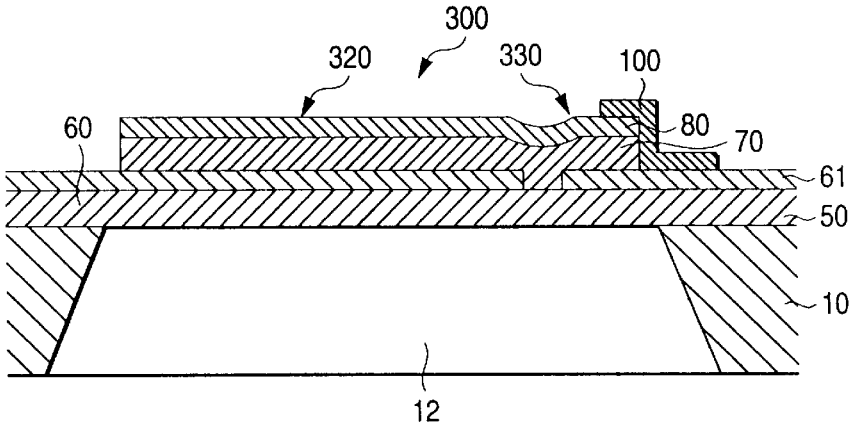

FIGS. 7A and 7B are a plan view and a sectional view in the longitudinal direction of the main part of the ink jet recording head thus formed.

As shown in FIG. 7, the lower electrode film 60 forming the piezoelectric element 300 is provided continuously in the area facing the pressure generating chambers 12 placed side by side and is patterned in the proximity of one end portion in the longitudinal direction of the pressure generating chamber 12, and the end portion of the lower electrode film 60 becomes one end portion of the active part of piezoelectric element 320. In the area facing the proximity of an opposite end portion in the longitudinal direction of the pressure generating chamber 12, the wiring lower electrode film 61 discontinuous with the lower electrode film 60 and used as wiring of the piezoelectric element is provided for each pressure generating chamber 12 from the area facing the pressure generating chamber 12 to the top of the peripheral wall.

Preferably, the spacing between the lower electrode film 60 and the wiring lower electrode film 61 and the spacing between the wiring lower electrode films 61 are each formed of a narrow width to such an extent that at least the insulating strength can be held.

Figure 8:
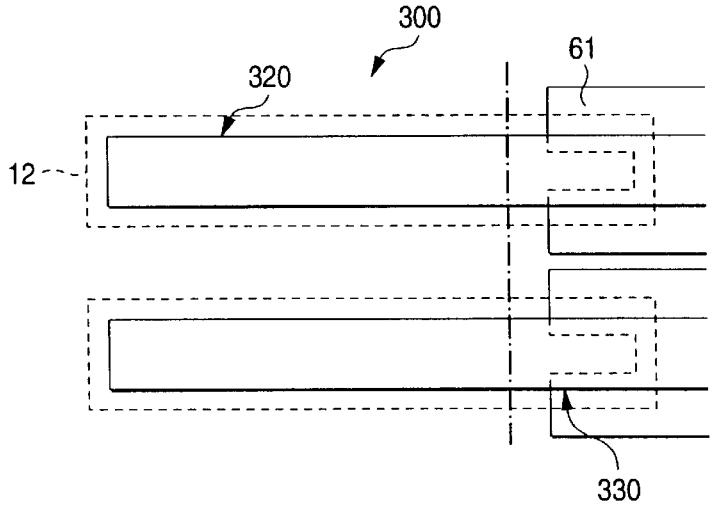
FIG. 8 is a plan view to show a modified example of the ink jet recording head according to the first embodiment of the present invention.

On the other hand, in the embodiment, the piezoelectric film 70 and the upper electrode film 80 are provided in the area facing the pressure generating chamber 12 and are extended onto the wiring lower electrode film 61, and the upper electrode film 80 and the wiring lower electrode film 61 are connected by a lead electrode 100. The form of the wiring lower electrode film 61 is not limited; however, preferably the wiring lower electrode film 61 is formed at least covering the margin of the pressure generating chamber 12 as shown in FIG. 8, whereby the rigidity of the diaphragm is held high and a crack of the diaphragm can be prevented from occurring.

In such a configuration, the piezoelectric film 70 and the upper electrode film 80 placed on the lower electrode film 60 make up one active part of piezoelectric element 320. The portions of piezoelectric film 70 and the upper electrode film 80 extended continuously from the active part of piezoelectric element 320 in the area where the lower electrode film 60 is removed and on the wiring lower electrode film 61 make up an inactive part of piezoelectric element 330 which has the piezoelectric film, but is not substantially driven.

Therefore, the boundary between the pressure generating chamber 12 and the peripheral wall is the inactive part of piezoelectric element 330 which is not driven even if a voltage is applied to the active part of piezoelectric element 320, so that there is not a fear of peeling of the piezoelectric film 70, etc., a crack caused by repetitive displacement, or the like at the end portion in the longitudinal direction of the pressure generating chamber 12. Since the piezoelectric film 70 and the upper electrode film 80 are extended onto the wiring lower electrode film 61, the need for forming a contact hole, namely, the need for forming an insulation film formed with a contact hole on the upper electrode film 80 is eliminated. Therefore, displacement degradation of the active part of piezoelectric element 320 caused by the thickness of an insulation film is eliminated. The manufacturing steps can also be decreased, making it possible to reduce the costs.

In the described film formation and anisotropic etching sequence of the active part of piezoelectric elements 320, the pressure generating chambers 12, etc., a large number of chips are formed on one wafer at the same time and after the process terminates, they are separated for each channel substrate 10 of one chip size as shown in FIG. 1. Each channel substrate 10 is bonded to the sealing plate 20, the ink reservoir substrate 30, and the ink reservoir side plate 40 in order in one piece to form an ink jet recording head.

With the described ink jet recording head, ink is taken in through the ink introduction port 42 connected to external ink supply member (not shown) and the inside of the recording head from the ink reservoir 31 to the nozzle orifices 11 is filled with ink, then a voltage is applied to the part between the upper electrode film 80 and the lower electrode film 60 according to a record signal from an external drive circuit (not shown) for deflection-deforming the elastic film 50, the lower electrode film 60, and the piezoelectric film 70, thereby raising pressure in the corresponding pressure generating chamber 12 and jetting an ink drop through the corresponding nozzle orifice 11.

In the embodiment, the piezoelectric film 70 and the upper electrode film 80 are formed in the area facing the pressure generating chamber 12, but the scope of the present invention is not limited thereto. For example, they may be extended to the area facing the peripheral wall. Of course, according to such a configuration, advantages similar to those described above can also be provided.

In the above-described example, the inactive part of piezoelectric element 330 is formed by removing the lower electrode film 60, but the scope of the present invention is not limited thereto. For example, the inactive part of piezoelectric element 330 may be formed by placing a low dielectric insulation layer between the piezoelectric film 70 and the upper electrode film 80 or may be formed by partially doping, etc., the piezoelectric film 70 for making it inactive.

Figure 9:
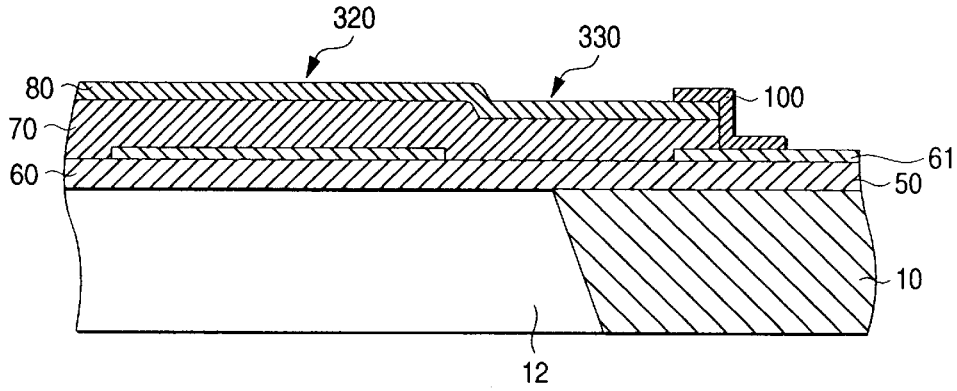
FIG. 9 is a sectional view to show the main part of an ink jet recording head according to a second embodiment of the present invention.

FIG. 9 is a sectional view in the longitudinal direction of the main part of an ink jet recording head according to a second embodiment of the present invention.

The second embodiment is another example of the wiring method of active part of piezoelectric elements 320. As shown in FIG. 9, the second embodiment is similar to the first embodiment except that a wiring lower electrode film 61 is provided on the top of a peripheral wall rather than in the area facing a pressure generating chamber 12.

Of course, in such a configuration, advantages similar to those of the first embodiment can also be provided.

Figure 10:
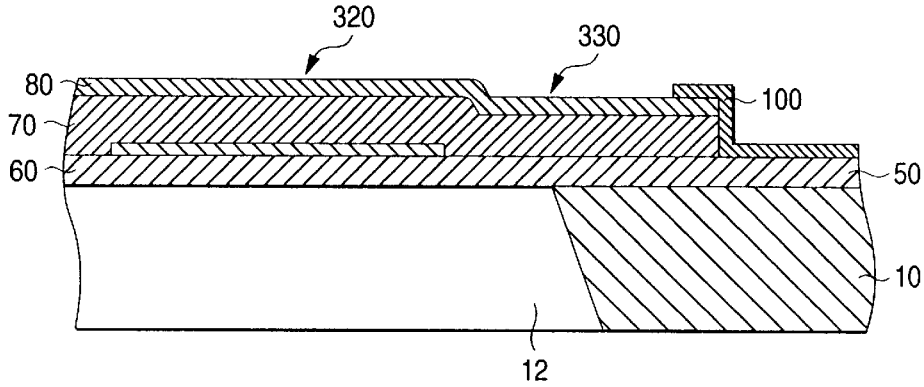
FIG. 10 is a sectional view to show a modified example of the ink jet recording head according to the second embodiment of the present invention.

In the above-described embodiment, the wiring lower electrode film 61 is provided outside the lower electrode film 60, but the scope of the present invention is not limited thereto. For example, as shown in FIG. 10, a lead electrode 100 which is connected to an upper electrode film 80 of an inactive part of piezoelectric element 330 extended to the top of a peripheral wall and is extended to the substrate end portion may be provided separately.

Figure 11:
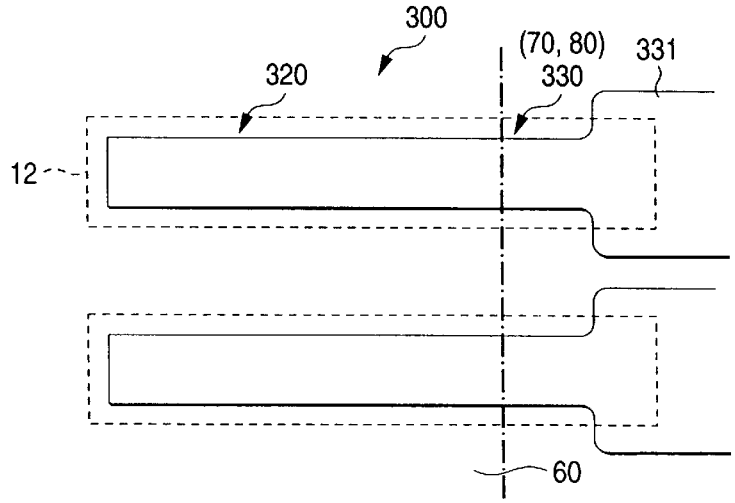
FIG. 11 is a plan view to show a modified example of the ink jet recording head according to the second embodiment of the present invention.

A piezoelectric film 70 and the upper electrode film 80 making up the inactive part of piezoelectric element 330 extended from the end portion of the pressure generating chamber 12 to the top of the peripheral wall are not limited. However, for example, as shown in FIG. 11, preferably a wider portion 331 wider than the pressure generating chamber 12 is formed in the proximity of the end portion of the pressure generating chamber 12 for covering the end portion of the pressure generating chamber 12, whereby the rigidity of a diaphragm in the proximity of the end portion of the pressure generating chamber 12 is held high and a crack of the diaphragm can be prevented from occurring.

Figure 12A:
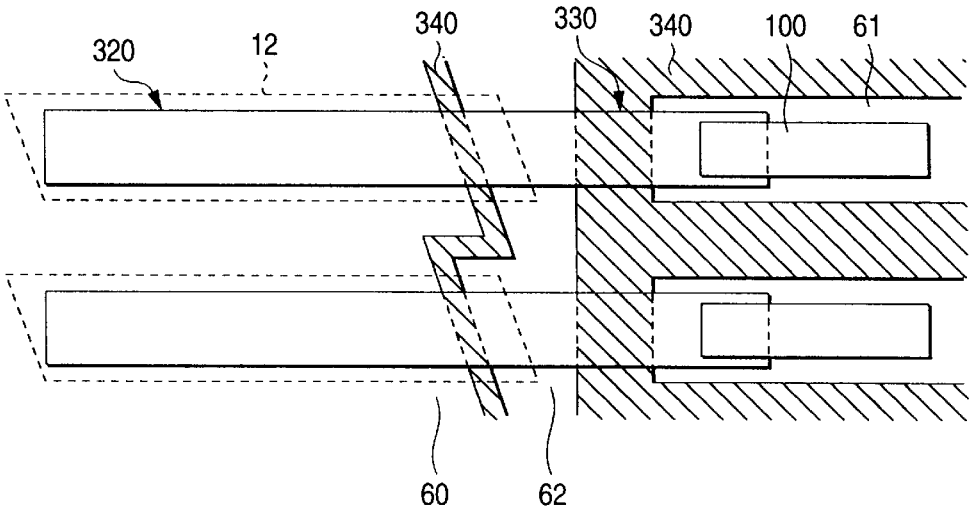
FIGS. 12A and 12B are a plan view and a sectional view to show the main part of an ink jet recording head according to a third embodiment of the present invention.
Figure 12B:
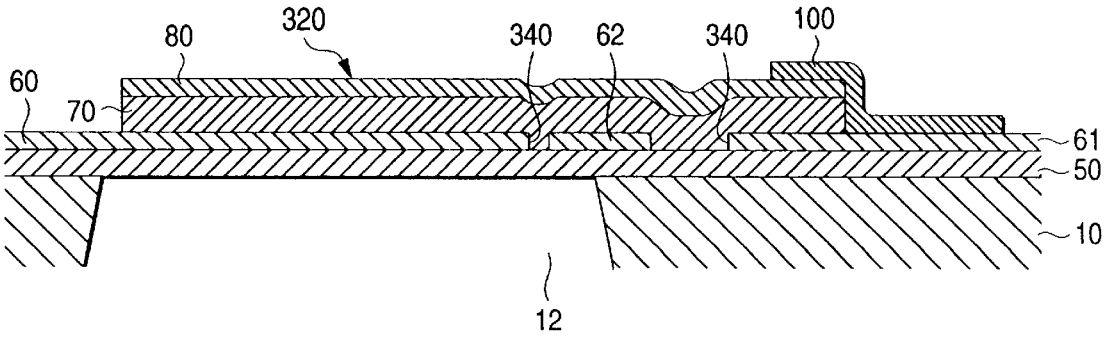

FIGS. 12A and 12B are a plan view and a sectional view in the longitudinal direction of the main part of an ink jet recording head according to a third embodiment of the present invention.

The third embodiment is an example wherein a discontinuous lower electrode film 62 discontinuous with a lower electrode film 60 is provided below an inactive part of piezoelectric element 330 in the area facing the boundary between the end portion and peripheral wall of each pressure generating chamber 12, as shown in FIG. 12. That is, the third embodiment is similar to the second embodiment except that the lower electrode film 60 in the proximity of one longitudinal end portion of the pressure generating chamber 12 on which a piezoelectric film 70 and an upper electrode film 80 across is removed to form, for example, a narrow groove-like removed portion 340 extended in the width direction of the pressure generating chambers 12, and except that the lower electrode film 60 in the boundary between the end portion and the peripheral wall of each pressure generating chamber 12 becomes the discontinuous lower electrode film 62 discontinuous with the lower electrode film 60 of the active part of piezoelectric element 320.

The width of the removed portion 340 separating the lower electrode film 60 and the discontinuous lower electrode film 62 needs to be a width at least capable of holding the insulating strength between the lower electrode film 60 and the discontinuous lower electrode film 62; however, preferably the removed portion 340 is made narrow as much as possible for holding the rigidity of a diaphragm.

In such a configuration, the discontinuous lower electrode film 62 becomes a floating electrode not electrically connected to any other parts, the piezoelectric film 70 and the upper electrode film 80 existing on the lower electrode film 60 make up the active part of piezoelectric element 320 which becomes a substantial drive part, and the piezoelectric film 70 and the upper electrode film 80 on the discontinuous lower electrode film 62 are not strongly driven.

Therefore, the boundary between the pressure generating chamber 12 and the peripheral wall thereof is not strongly driven if a voltage is applied to the active part of piezoelectric element 320, thus the rigidity of the diaphragm at the end portion in the longitudinal direction of the pressure generating chamber 12 is high and destruction of the diaphragm or the piezoelectric film 70 or the like in the portion can be prevented.

Figure 13:
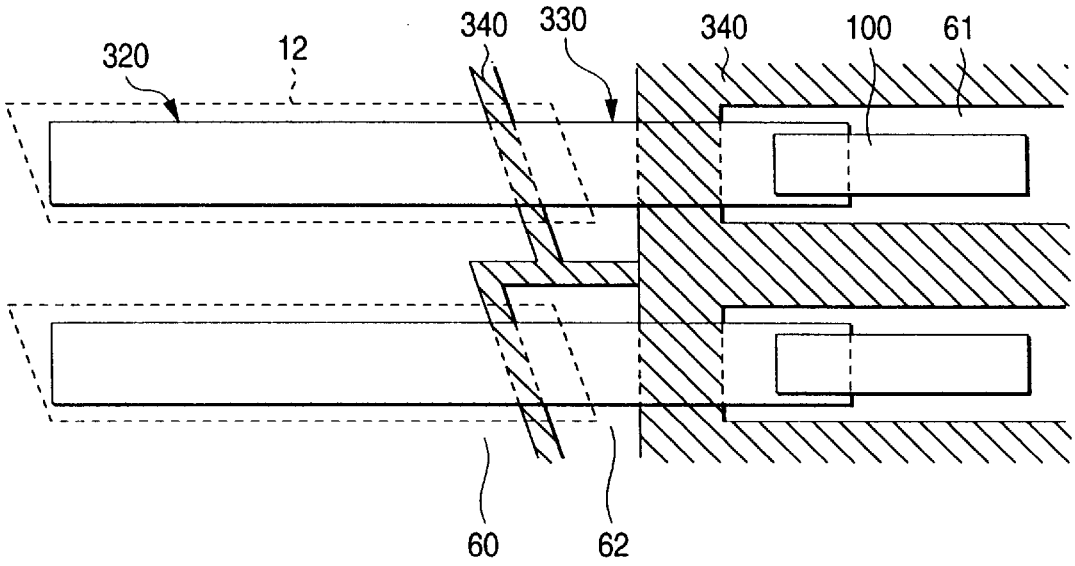
FIG. 13 is a plan view to show a modified example of the ink jet recording head according to the third embodiment of the present invention.

In the embodiment, the discontinuous lower electrode film 62 is formed over the area in the direction in which the pressure generating chambers 12 are placed side by side, but the scope of the present invention is not limited thereto. For example, as shown in FIG. 13, separate discontinuous lower electrode films 62 may be provided in a one-to-one correspondence with the active part of piezoelectric elements 320, whereby the piezoelectric film 70 and the upper electrode film 80 on the discontinuous lower electrode film 62 become the inactive part of piezoelectric element 330 which is not driven at all, and destruction of the diaphragm or the piezoelectric film 70 or the like can be prevented more reliably.

In the embodiment, the discontinuous lower electrode film 62 is a floating electrode not electrically connected to any other parts, but the scope of the present invention is not limited thereto. For example, the discontinuous lower electrode film 62 may be connected to an electrode layer via a resistor having a predetermined resistance value so that the charge time constant becomes larger than the drive pulse of the active part of piezoelectric element 320.

Figure 14:
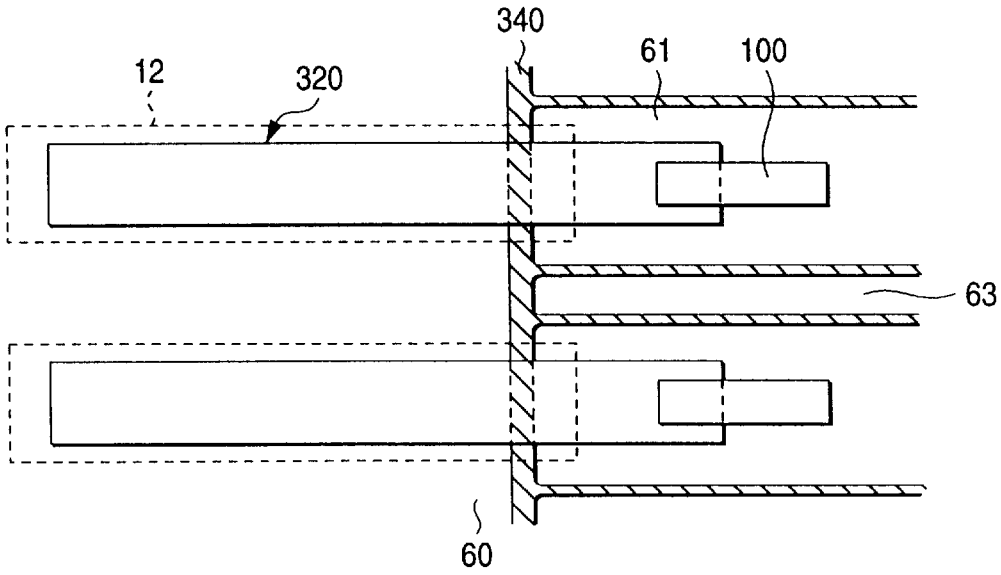
FIG. 14 is a plan view to show the main part of an ink jet recording head according to a fourth embodiment of the present invention.

FIG. 14 is a plan view of the main part of an ink jet recording head according to a fourth embodiment of the present invention.

The ink jet recording head of the fourth embodiment has a similar configuration to that of the ink jet recording head of the first embodiment except that an intermediate electrode film 63 which is separated by a removed portion 340 and is not connected to any other parts is provided between wiring lower electrode films 61.

According to such a configuration, the width of the removed portion 340 separating the wiring lower electrode films 61 can be made narrow. That is, since the intermediate electrode film 63 is provided between wiring lower electrode films 61, if the removed portion 340 is made narrow, the insulating strength can be held reliably, whereby the rigidity of a diaphragm becomes higher and as in the above-described embodiment, destruction of the diaphragm or a piezoelectric film 70 or the like can be prevented in the boundary between a pressure generating chamber 12 and peripheral wall thereof.

Figure 15A:
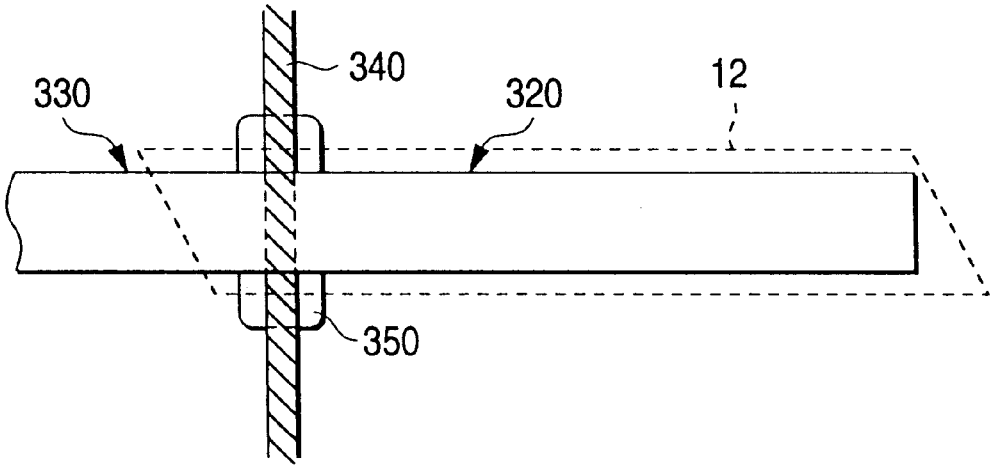
FIGS. 15A and 15B are a plan view and a sectional view to show a modified example of the ink jet recording head according to the fourth embodiment of the present invention.
Figure 15B:
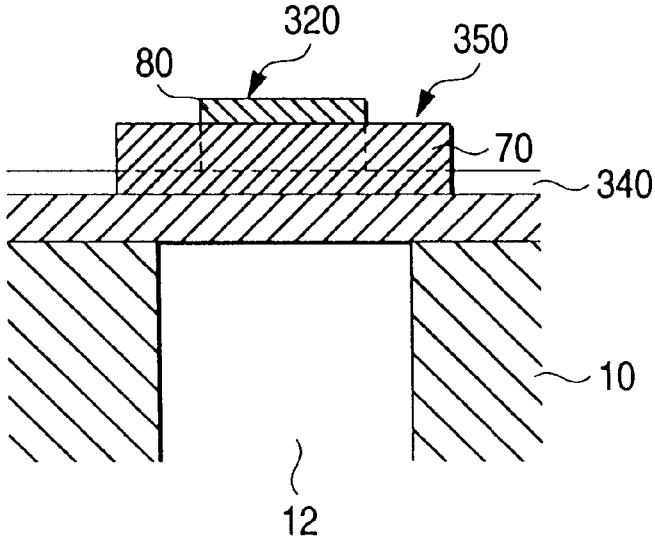

In the above-described embodiment, the removed portion 340 between the lower electrode film 60 and the wiring lower electrode film 61 is formed so as to have a width to such an extent that the insulating strength between the lower electrode film 60 and the wiring lower electrode film 61 can be held. However, for example, as shown in FIG. 15, an inert part 350 where an upper electrode film 80 is removed and the piezoelectric film 70 not substantially driven is left may be provided in a portion where a dielectric breakdown easily occurs, such as both sides of an active part of piezoelectric element 320 in the width direction thereof, whereby the insulating strength can be held more reliably. If the piezoelectric film 70 is not driven, the upper electrode film 80 need not be removed, needless to say.

Figure 16A:
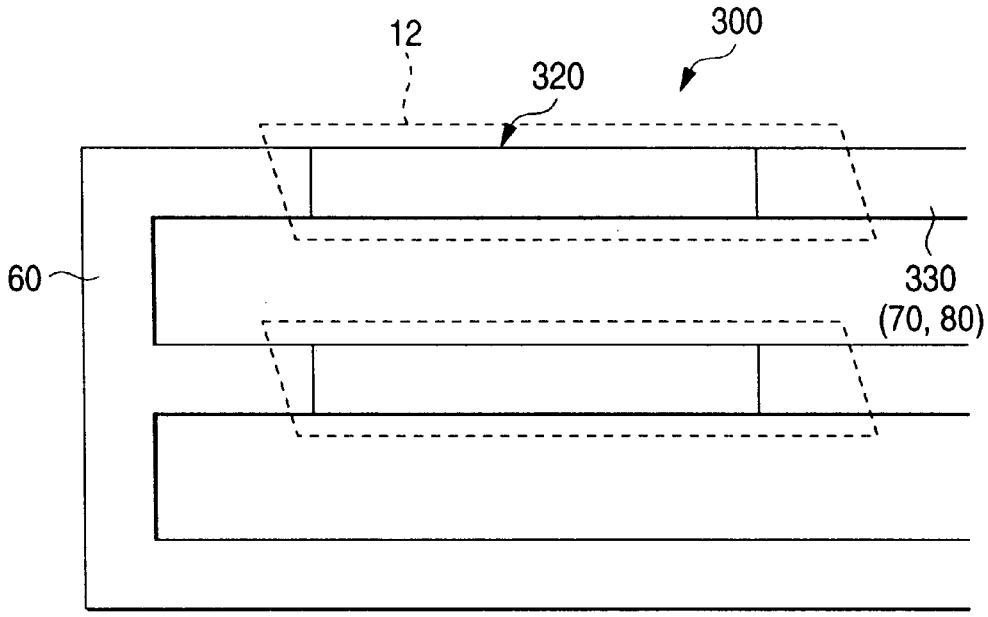
FIGS. 16A and 16B are a plan view and a sectional view to show the main part of an ink jet recording head according to a fifth embodiment of the present invention.
Figure 16B:
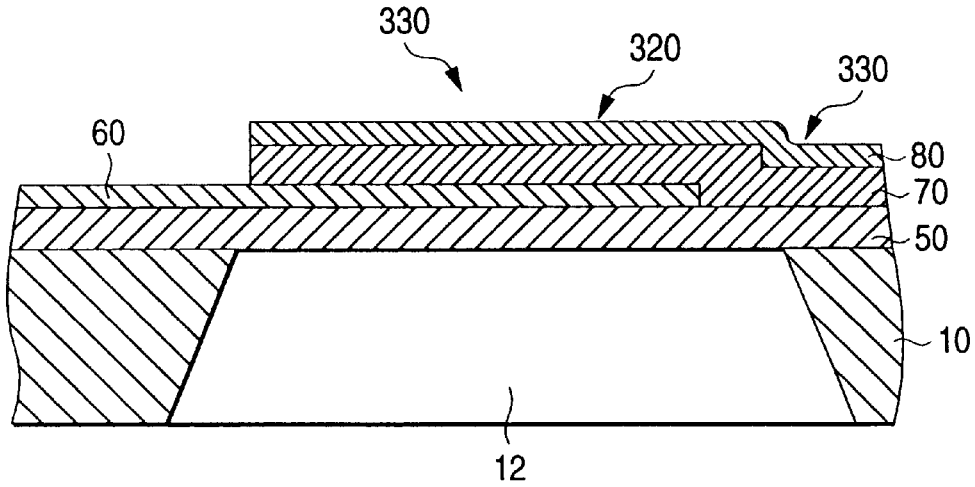

FIGS. 16A and 16B are a plan view and a sectional view in the longitudinal direction of the main part of an ink jet recording head according to a fifth embodiment of the present invention.

The fifth embodiment is similar to the first embodiment except that in place of wiring lower electrode film 61, a piezoelectric film 70 and an upper electrode film 80 making up an inactive part of piezoelectric element 330 are extended from the area facing a pressure generating chamber 12 to the top of a peripheral wall and in the proximity of the end portion thereof, for example, external wiring such as a flexible cable and the upper electrode film 80 are connected directly (not shown), and except that a lower electrode film 60 basically is provided in the area facing the pressure generating chamber 12 and is extended from the end portion on the opposite side to the inactive part of piezoelectric element 330 to the top of the peripheral wall of the pressure generating chamber 12, forming a common electrode to piezoelectric elements 300, as shown in FIG. 16.

According to such a configuration, advantages similar to those of the embodiments described above can also be provided, of course. Since the lower electrode film 60 and the upper electrode film 80 are extended from the end portion in the longitudinal direction of the pressure generating chamber 12 to the top of the peripheral wall in the opposite direction, wiring can be easily drawn without short-circuiting the lower electrode film 60 and the upper electrode film 80.

Figure 17A:
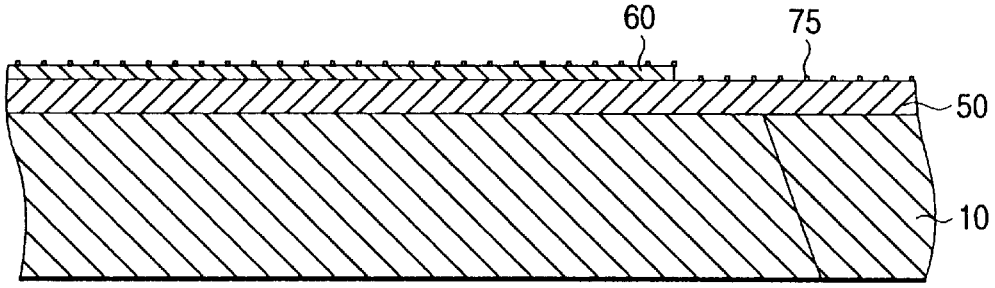
FIGS. 17A to 17C are sectional views to show a manufacturing process of the ink jet recording head according to the fifth embodiment of the present invention.
Figure 17B:
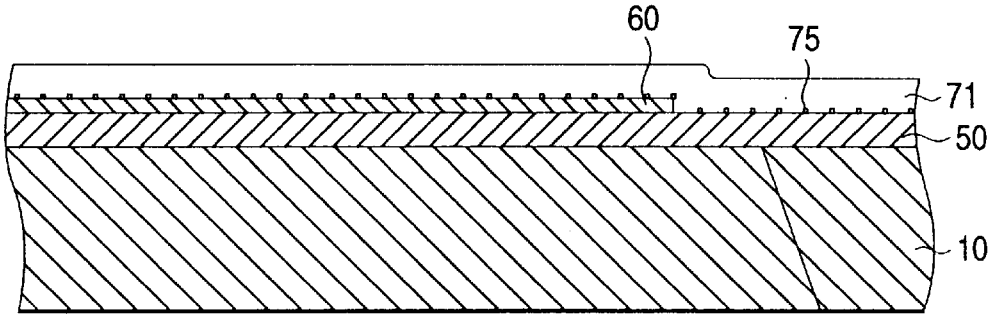
Figure 17C:
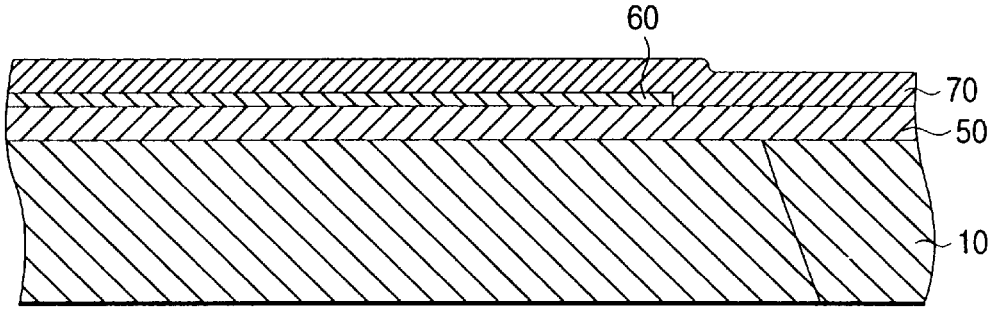

To form the piezoelectric film 70 continuously from the pressure generating chamber 12 to the top of the peripheral wall as in the fifth embodiment, preferably the crystalline structure of the piezoelectric film 70 on the lower electrode film 60 is the same as that on an elastic film 50. Thus, preferably, the piezoelectric film 70 is formed as follows:

As shown in FIG. 17A, before the piezoelectric film 70 is formed, crystal seed 75 made of titanium or titanium oxide is formed like islands on both of the lower electrode film 60 and the elastic film 50 by a sputtering method, then an uncrystallized piezoelectric precursor layer 71 is formed as shown in FIG. 17B, then baked for crystallization to form the piezoelectric film 70 as shown in FIG. 17C.

To use the method of thus forming the crystal seed 75, preferably the elastic film 50 is formed of a material having a good adhesive contact property with the piezoelectric film 70, for example, oxide or nitride of at least one element selected from among the elements of the piezoelectric film 70, such as zirconium oxide.

An art of forming crystal seed and aligning crystal substantially in one orientation to form a piezoelectric film 70 on a lower electrode film 60 made of platinum, etc., is known. However, in a special structure wherein piezoelectric film 70 is formed after lower electrode film 60 is patterned as in the embodiment, if crystal seed is previously formed on the lower electrode film 60, a different crystal structure results on elastic film 50 and a crack easily occurs. Then, in the embodiment, crystal seed 75 is also formed on the elastic film 50, whereby the crystal structure of the piezoelectric film 70 is made almost the same on the lower electrode film 60 and the elastic film 50, thereby preventing cracks and an abnormal stress from occurring. The crystal seed on the elastic film 50 may be formed at the same time after the lower electrode film 60 is patterned. Alternatively, after crystal seed on the lower electrode film 60 is formed and patterning is executed, crystal seed may be formed separately on the elastic film 50 only, in which case the crystal seed may be formed like a film rather than like islands.

Figure 18:
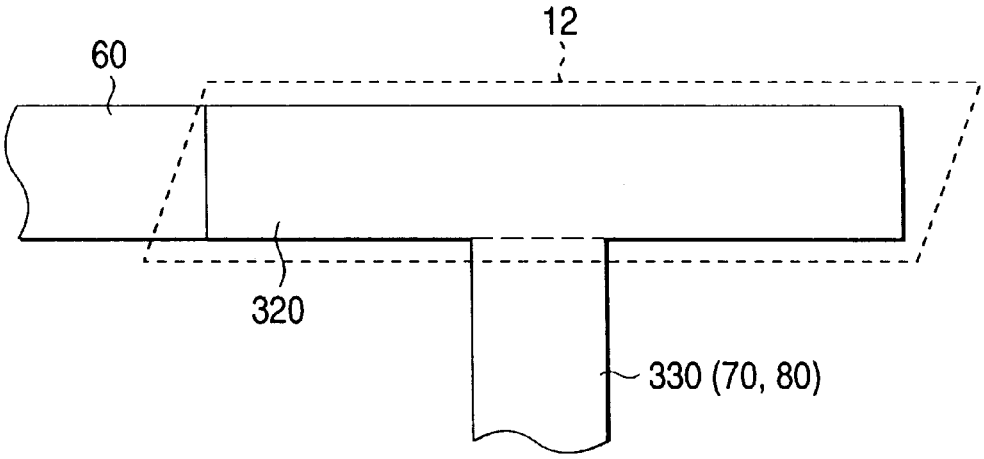
FIG. 18 is a plan view to show the main part of an ink jet recording head according to a sixth embodiment of the present invention.

FIG. 18 is a plan view of the main part of an ink jet recording head according to a sixth embodiment of the present invention.

The sixth embodiment is similar to the fifth embodiment except that an inactive part of piezoelectric element 330 is provided in the area facing a peripheral wall of a pressure generating chamber 12 in the width direction thereof from the substantially central part of an active part of piezoelectric element 320, as shown in FIG. 18.

According to such a configuration, in addition to advantages similar to those of the embodiments described above, concentration of an electric field on a piezoelectric film 70 in the proximity of the coupling portion of the active part of piezoelectric element 320 and the inactive part of piezoelectric element 330 can be suppressed and destruction of a piezoelectric film 70, etc., can be prevented.

Figure 19:
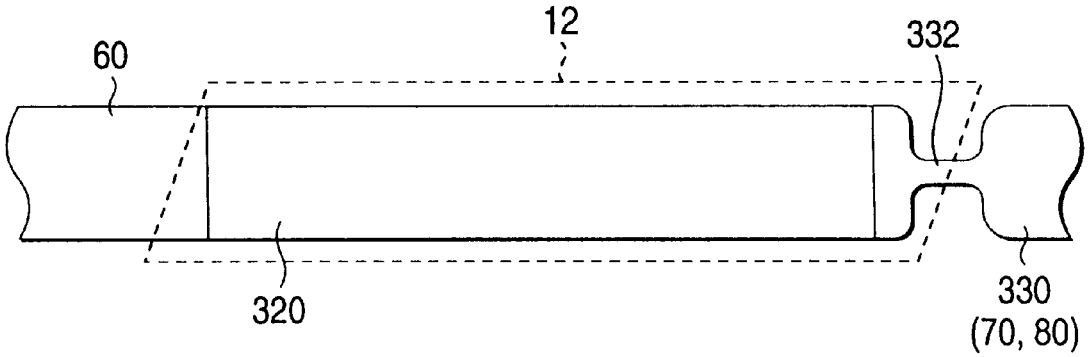
FIG. 19 is a plan view to show the main part of an ink jet recording head according to a seventh embodiment of the present invention.

FIG. 19 is a plan view of the main part of an ink jet recording head according to a seventh embodiment of the present invention.

The seventh embodiment is similar to the fifth embodiment except that a narrowed portion 332 narrower than an active part of piezoelectric element 320 is formed in the area of an inactive part of piezoelectric element 330 facing the end portion in the longitudinal direction of a pressure generating chamber 12, as shown in FIG. 19.

In such a configuration, regulation on displacement of a diaphragm at the end portion of the pressure generating chamber 12 is relaxed, so that the displacement amount of the diaphragm caused by drive of the active part of piezoelectric element 320 at the end portion can be increased.

In the embodiment, an upper electrode film 80 and a piezoelectric film 70 making up the inactive part of piezoelectric element 330 are made narrow, but the scope of the present invention is not limited thereto. For example, only the upper electrode film 80 may be made narrow.

Figure 20A:
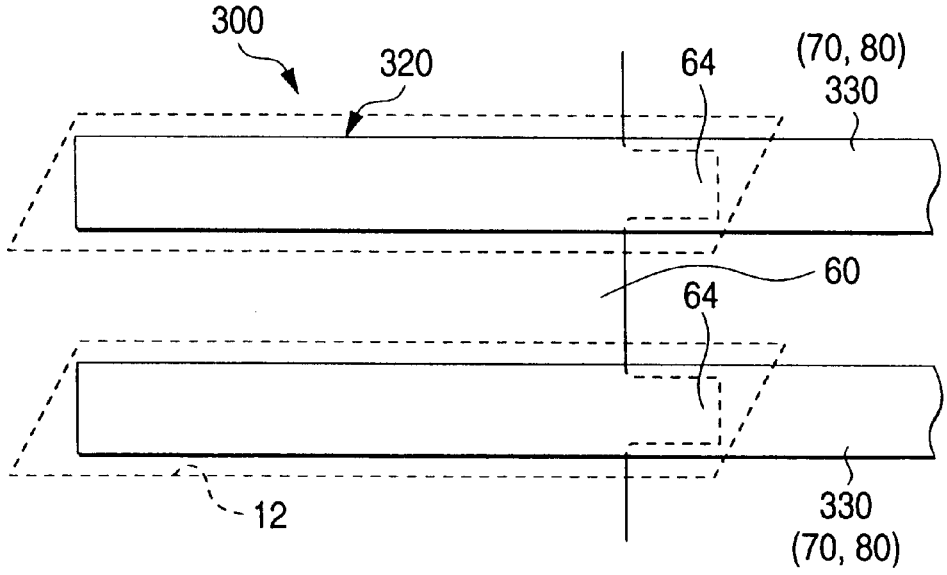
FIGS. 20A and 20B are a plan view and a sectional view to show the main part of an ink jet recording head according to an eighth embodiment of the present invention.
Figure 20B:
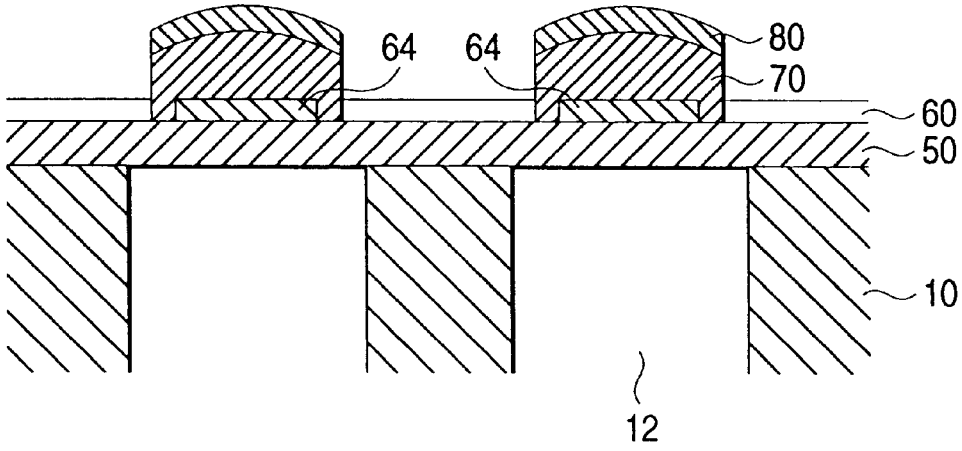

FIGS. 20A and 20B are a plan view and a sectional view in the width direction of the main part of an ink jet recording head according to an eighth embodiment of the present invention.

The eighth embodiment is similar to the first embodiment except that in the proximity of the end portion of a pressure generating chamber 12, a lower electrode film 60 in the boundary of an active part of piezoelectric element 320 with an inactive part of piezoelectric element 330 is removed on both sides in the width direction of the pressure generating chamber 12, forming a narrowed portion 64 narrower than any other portions and except that the narrowed portion 64 is made narrower than a piezoelectric film 70 in the area facing the pressure generating chamber 12 and is covered on both end faces in the width direction with the piezoelectric film 70, as shown in FIG. 20.

According to such a configuration, an upper electrode film 80 and the lower electrode film 60 are reliably insulated in the proximity of the end portion of the lower electrode film 60 of the pressure generating chamber 12, namely, at the end portion of the active part of piezoelectric element 320, and discharge does not occur between the upper electrode film 80 and the lower electrode film 60. Therefore, a dielectric breakdown of the piezoelectric film 70, etc., can be prevented.

Figure 21A:
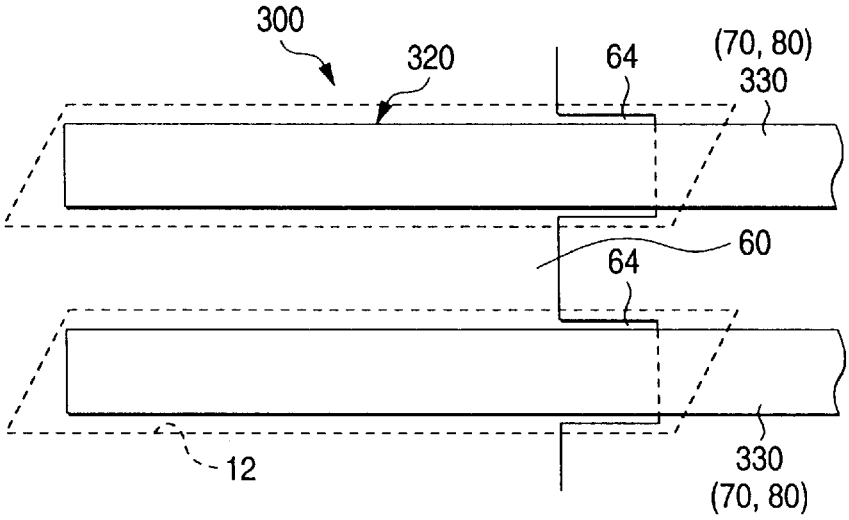
FIGS. 21A to 21C are a plan view and sectional views to show the main part of an ink jet recording head according to a ninth embodiment of the present invention.
Figure 21B:
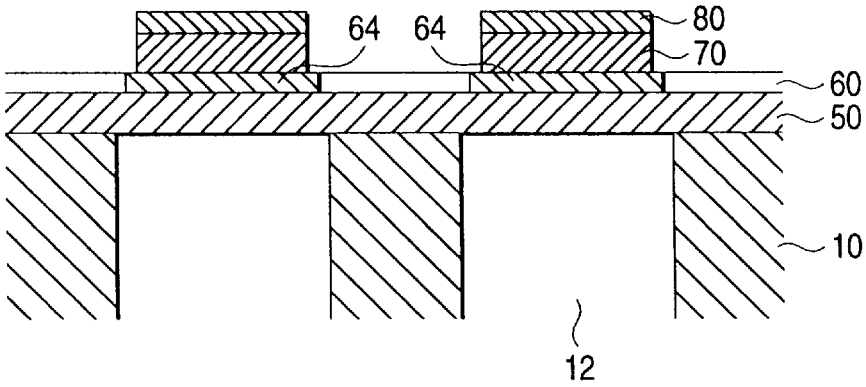
Figure 21C:
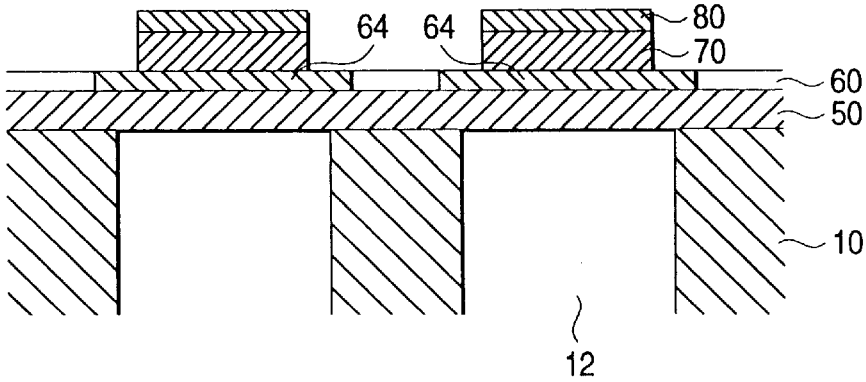

FIGS. 21A to 21C are a plan view and sectional views in the width direction of the main part of an ink jet recording head according to a ninth embodiment of the present invention.

The ninth embodiment is similar to the eighth embodiment except that a narrowed portion 64 of a lower electrode film 60, which is formed in the area facing a pressure generating chamber 12, is made wider than a piezoelectric film 70, and except that the piezoelectric film 70 and an upper electrode film 80 are extended via the top of the narrowed portion 64 to the top of a peripheral wall of the pressure generating chamber 12 to form an inactive part of piezoelectric element 330, as shown in FIG. 21.

It is known that generally if the distance between electrodes is a given value or less, discharge does not occur between the electrodes, as shown on a graph called Paschen curve. For example, in the embodiment, the distance between the end face of the narrowed portion 64 in the width direction thereof and the end face of the upper electrode film 80 in the width direction thereof may be about 10 $\mu$m or less; in the embodiment, the distance is set to about 7 $\mu$m.

Therefore, also in such a configuration, discharge is prevented between the upper electrode film 80 and the lower electrode film 60 at the end portion in the longitudinal direction of the pressure generating chamber 12 and a dielectric breakdown of the piezoelectric film 70 can be prevented, as in the eighth embodiment.

In the embodiment, the narrowed portion 64 is provided in the area facing the pressure generating chamber 12, but the scope of the present invention is not limited thereto. The distance may be a distance at which discharge does not occur between the upper electrode film 80 and the lower electrode film 60; for example, as shown in FIG. 21C, the narrowed portion 64 may be extended to the top of the peripheral wall of the pressure generating chamber 12 in the width direction thereof.

Figure 22:
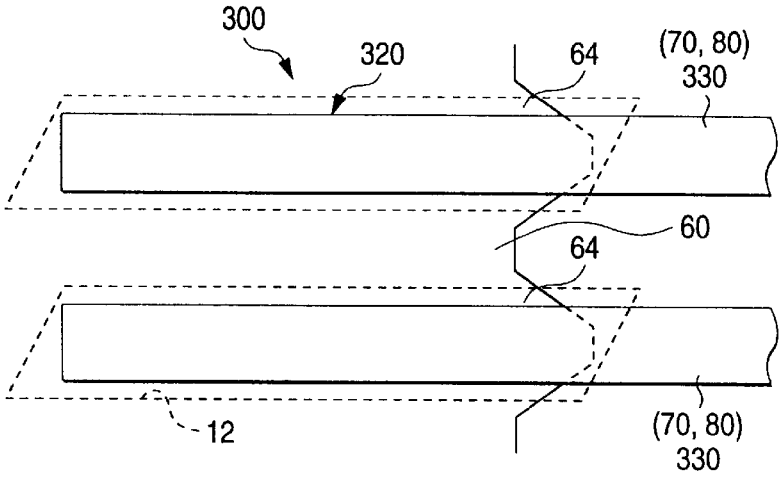
FIG. 22 is a plan view to show the main part of an ink jet recording head according to a tenth embodiment of the present invention.

FIG. 22 is a plan view of the main part of an ink jet recording head according to a tenth embodiment of the present invention.

The tenth embodiment is similar to the eighth embodiment except that a narrowed portion 64 of a lower electrode film 60 is formed substantially like a trapezoid gradually narrowed to the distal end thereof and is covered at least at the distal end with a piezoelectric film 70 in the area facing a pressure generating chamber 12, as shown in FIG. 22.

Thus, at the end portion of the lower electrode film 60, the piezoelectric film 70 becomes easily thin and concentration of an electric field easily occurs and therefore particularly a dielectric breakdown of the piezoelectric film 70, etc., easily occurs. However, since the narrowed portion 64 is covered at the distal end with the piezoelectric film 70 and the lower electrode film 60 and an upper electrode film 80 are insulated, discharge does not occur therebetween and a dielectric breakdown of the piezoelectric film 70, etc., can be prevented.

Figure 23A:
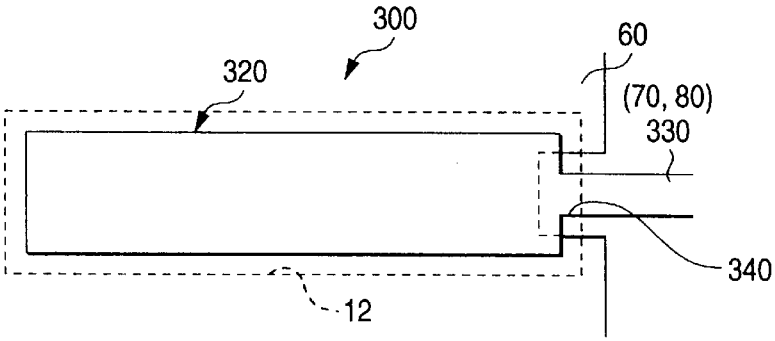
FIGS. 23A and 23B are a plan view and a sectional view to show the main part of an ink jet recording head according to an eleventh embodiment of the present invention.
Figure 23B:
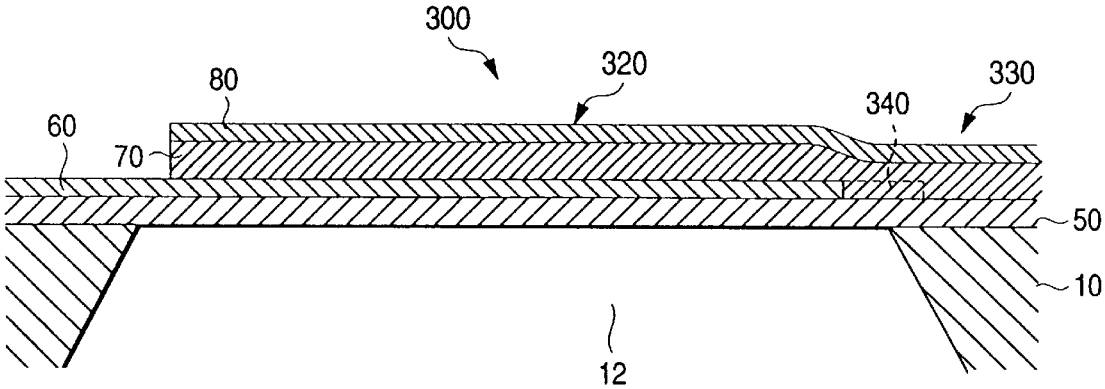

FIGS. 23A and 23B are a plan view and a sectional view of the main part of an ink jet recording head according to an eleventh embodiment of the present invention.

The eleventh embodiment is similar to the first embodiment except that a piezoelectric film 70 and an upper electrode film 80 are extended as a width narrower than an active part of piezoelectric element 320 continuously from one end portion in the longitudinal direction of a pressure generating chamber 12 to the area facing a peripheral wall, forming an inactive part of piezoelectric element 330, the upper electrode film 80 and external wiring being connected in the proximity of the end portion of the inactive part of piezoelectric element 330, except that a lower electrode film 60 basically is formed covering the area facing each pressure generating chamber 12, and that the area in which the piezoelectric film 70 and the upper electrode film 80 are extended, namely, the area in which the inactive part of piezoelectric element 330 is extended becomes a removed portion 340 removed as a narrower width than the pressure generating chamber 12, as shown in FIG. 23.

For the portion in which the piezoelectric film 70 and the upper electrode film 80 are extended from the end portion of the pressure generating chamber 12 to the top of the peripheral wall and the removed portion 340, preferably the direction in which the margin of the upper electrode film 80 crosses from the top of the lower electrode film 60 to the top of the removed portion 340 does not match the direction in which the upper electrode film 80 is extended to the top of the peripheral wall. That is, preferably the angle between the direction of the electric current flowing into the portion where the upper electrode film 80 crosses the lower electrode film 60 and the direction of the electric current flowing into the upper electrode film 80 extended becomes large. For example, in the embodiment, the angle between the directions of the electric fields flowing into the portions is about 90 degrees.

Thus, in the embodiment, the lower electrode film 60 in the portion where the piezoelectric film 70 and the upper electrode film 80 of the active part of piezoelectric element 320 are extended to the top of the peripheral wall is removed to form the removed portion 340, and any other area facing the pressure generating chamber 12 is covered with the lower electrode film 60, whereby the end portion of the lower electrode film 60 does not exist in the surroundings of the upper electrode film 80 forming a part of the active part of piezoelectric element 320 and discharge is hard to occur. In the extended portion of the piezoelectric film 70 and the upper electrode film 80, the direction of the electric current flowing into the portion where the upper electrode film 80 crosses the lower electrode film 60 does not match the direction of the electric current flowing into the upper electrode film 80 extended. Thus, the electric current flowing into the active part of piezoelectric element 320 from the upper electrode film 80 extended spreads and is dispersed in the cross portion with the lower electrode film 60, so that a dielectric breakdown of the piezoelectric film 70 caused by concentration of an electric field, etc., can be prevented, and the durability and reliability of the head can be enhanced.

Figure 24:
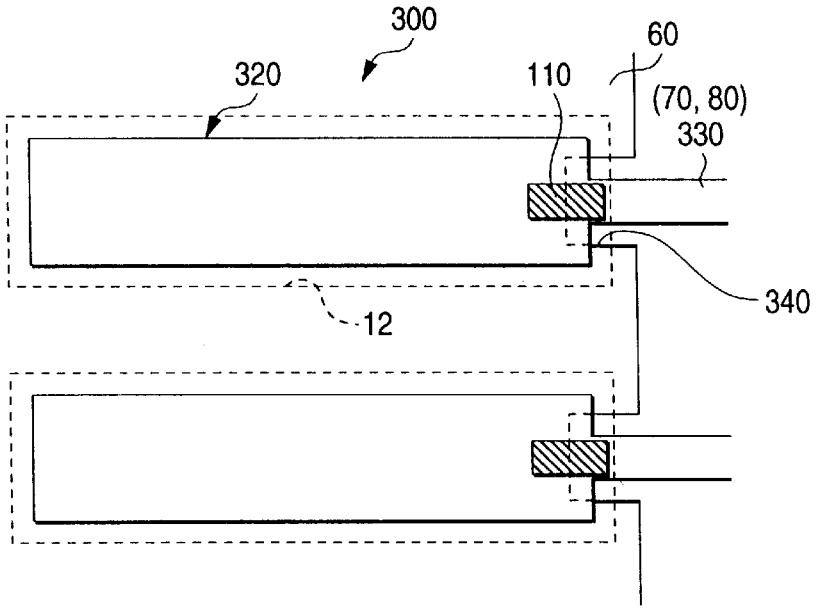
FIG. 24 is a plan view to show a modified example of the ink jet recording head according to the eleventh embodiment of the present invention.

For example, as shown in FIG. 24, a displacement suppression layer 110 for suppressing displacement of the active part of piezoelectric element 320 may be provided on the upper electrode film 80 in the boundary between the active part of piezoelectric element 320 and the inactive part of piezoelectric element 330, whereby vibration of the active part of piezoelectric element 320 at the end portion thereof and occurrence of a crack of a diaphragm caused by drive of the active part of piezoelectric element 320 or the like can be prevented. The displacement suppression layer 110 can be easily formed of the same material as a lead electrode 100 or the like, for example.

Figure 25A:
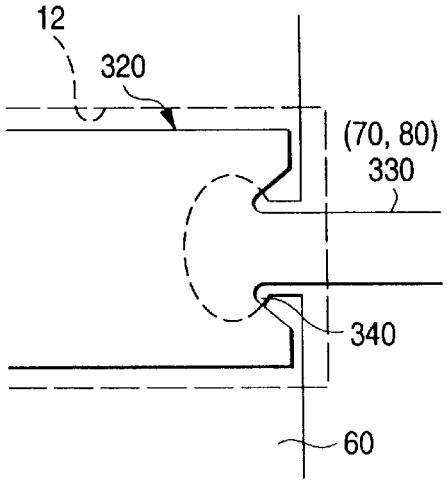
FIGS. 25A and 25B are plan views to show modified examples of the ink jet recording head according to the eleventh embodiment of the present invention.

In the embodiment, the lower electrode film 60 in the area corresponding to the piezoelectric film 70 and the upper electrode film 80 is removed substantially like a rectangle to form the removed portion 340, but the scope of the present invention is not limited thereto. For example, as shown in FIG. 25A, a removed portion 340 shaped substantially like an ellipse may be provided in the area facing the pressure generating chamber 12. In this case, the base end portions of the piezoelectric film 70 and the upper electrode film 80 extended as the width narrower than the active part of piezoelectric element 320 may be further removed to the inside of the active part of piezoelectric element 320, whereby the angle between the direction of the electric current flowing into the portion where the upper electrode film 80 crosses the lower electrode film 60 and the direction of the electric current flowing into the upper electrode film 80 extended becomes large. That is, the direction in which the electric current flowing into the active part of piezoelectric element 320 from the upper electrode film 80 extended spreads becomes large and the electric field applied to the part between the upper electrode film 80 and the lower electrode film 60 is further dispersed.

Figure 25B:
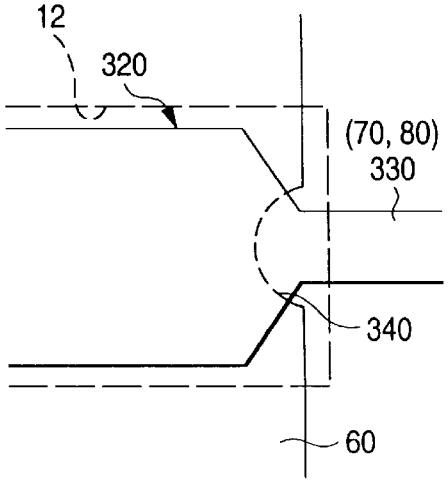

For example, as shown in FIG. 25B, the removed portion 340 may be shaped substantially like a semicircle, the width of the end portion of the active part of piezoelectric element 320 in the longitudinal direction thereof may be decreased gradually, and the lower electrode film 60 and the upper electrode film 80 may cross each other in the circular arc portion of the removed portion 340. Also according to such a configuration, the angle between the direction of the electric current flowing into the portion where the upper electrode film 80 crosses the lower electrode film 60 and the direction of the electric current flowing into the upper electrode film 80 extended becomes large. Therefore, the electric field applied to the part between the lower electrode film 60 and the upper electrode film 80 is dispersed, as described above.

Thus, the shapes of the removed portion 340 and the extension portion of the piezoelectric film 70 and the upper electrode film 80 are not limited, but preferably the angle between the direction of the electric current flowing into the portion where the upper electrode film 80 is extended and the direction of the electric current flowing into the portion crossing the lower electrode film 60 is set in the range of 5 to 180 degrees.

Figure 26:
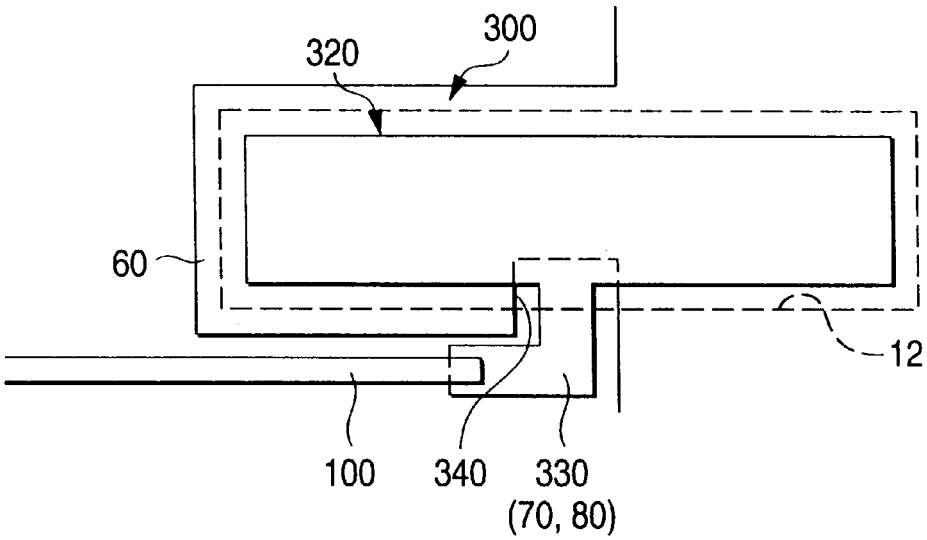
FIG. 26 is a plan view to show the main part of an ink jet recording head according to a twelfth embodiment of the present invention.

FIG. 26 is a plan view of the main part of an ink jet recording head according to a twelfth embodiment of the present invention.

The twelfth embodiment is similar to the eleventh embodiment except that a lower electrode film 60 is removed at the substantially central part in the longitudinal direction on the top of a peripheral wall on both sides of a pressure generating chamber 12 in the width direction thereof, forming a removed portion 340, except that a piezoelectric film 70 and an upper electrode film 80 are extended from the substantially central part of an active part of piezoelectric element 320 in the longitudinal direction thereof via the top of the removed portion 340 to the top of the peripheral wall, forming an inactive part of piezoelectric element 330, and except that the upper electrode film 80 extended to the top of the peripheral wall is connected to external wiring via a lead electrode 100, as shown in FIG. 26.

Thus, the piezoelectric film 70 and the upper electrode film 80 are extended from the central part of the pressure generating chamber 12 in the width direction thereof, whereby the drive loss of the active part of piezoelectric element 320 can be suppressed, activation can be accelerated, and the ink jet characteristic can be improved. Of course, advantages similar to those of the eleventh embodiment can also be provided.

Figure 27:
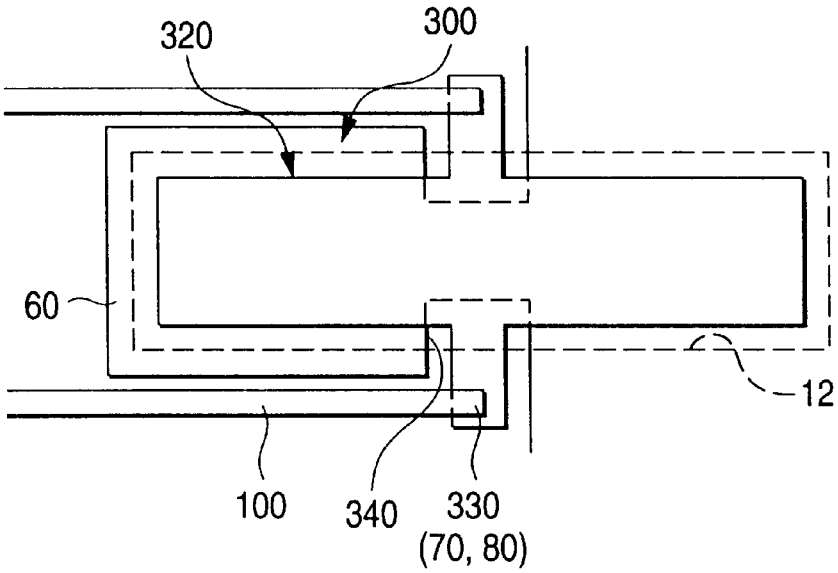
FIG. 27 is a plan view to show the main part of an ink jet recording head according to a thirteenth embodiment of the present invention.

FIG. 27 is a plan view of the main part of an ink jet recording head according to a thirteenth embodiment of the present invention.

The thirteenth embodiment is similar to the eleventh embodiment except that a piezoelectric film 70 and an upper electrode film 80 of an active part of piezoelectric element 320 are extended from both sides of a pressure generating chamber 12 in the width direction thereof to the top of a peripheral wall, forming an inactive part of piezoelectric element 330, as shown in FIG. 27.

According to such a configuration, advantages similar to those of the eleventh embodiment can also be provided. Since the piezoelectric film 70 and the upper electrode film 80 are extended from both sides of the pressure generating chamber 12 to the top of the peripheral wall, the drive loss of the active part of piezoelectric element 320 can be furthermore suppressed and the ink jet characteristic can be improved.

Figure 28A:
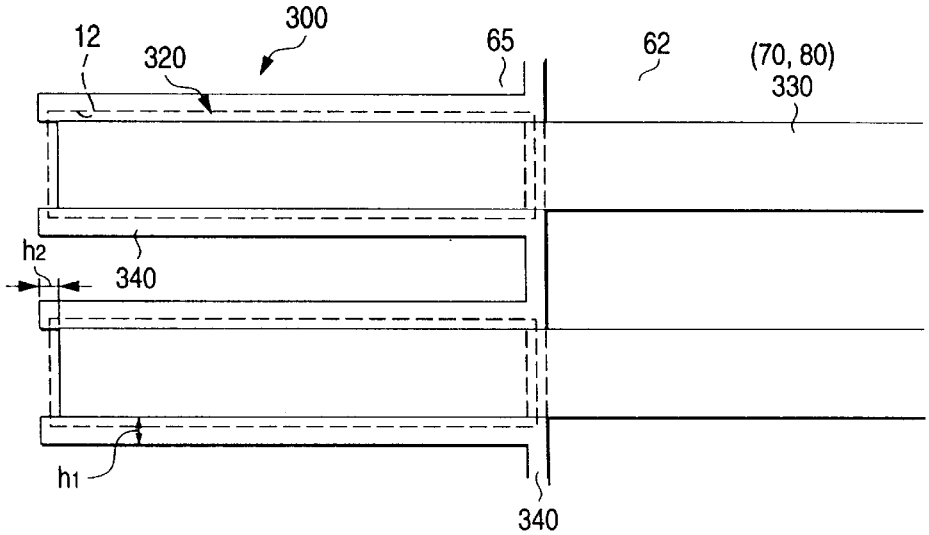
FIGS. 28A to 28C are a plan view and sectional views to show the main part of an ink jet recording head according to a fourteenth embodiment of the present invention.
Figure 28B:
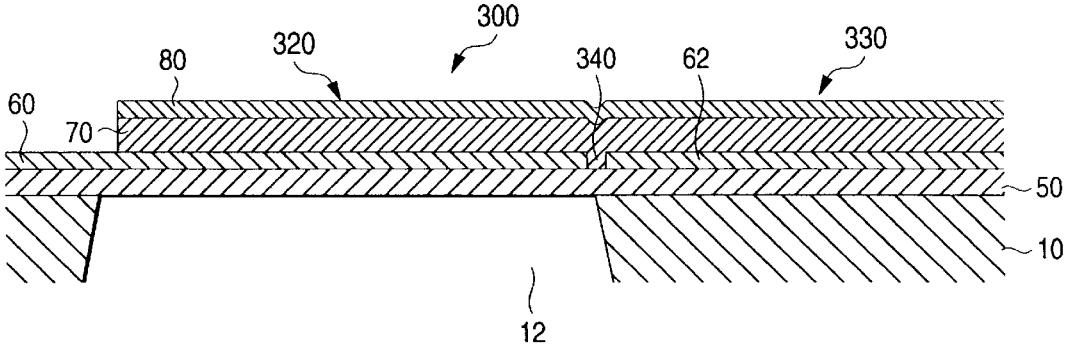
Figure 28C:
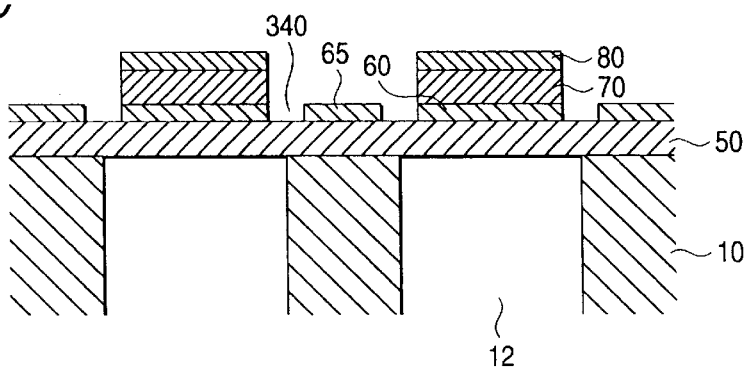

FIGS. 28A to 28C are a plan view and sectional views of the main part of an ink jet recording head according to a fourteenth embodiment of the present invention.

As shown in FIG. 28, the fourteenth embodiment is an example wherein a remaining part 65 made of the same layer as a lower electrode film 60 is provided on the top of a partition of a pressure generating chamber 12. The ink jet recording head according to the fourteenth embodiment has a similar configuration to that of the ink jet recording head according to the fifth embodiment except that the remaining part 65 is provided in the longitudinal direction of the pressure generating chamber 12 continuously with the lower electrode film 60 of an active part of piezoelectric element 320, that is, removed portions 340 with the lower electrode film 60 removed are provided in the areas facing the boundaries with the partitions on both sides in the width direction of the pressure generating chamber 12, whereby the remaining part 65 is formed in the area facing the partition.

Preferably, spacing h1 between the side at the end portion in the width direction of the lower electrode film 60 and the side at the end portion in the width direction of the remaining part 65 and spacing h2 between the side at the end portion in the longitudinal direction of a piezoelectric film 70 and the part where the lower electrode film 60 extended to the top of a peripheral wall becomes wide are wider than the film thickness of the piezoelectric film 70 and narrower than the width of the lower electrode film 60.

Preferably, the width of the remaining part 65 is 50% or more of the width of the partition; more preferably 80% or more. Further, preferably the lower electrode film 60 or the remaining part 65 is formed in the area of at least 50% or more of the area facing the pressure generating chambers 12 placed side by side and the partitions on both sides in the width direction of the pressure generating chambers 12.

In the embodiment, in the proximity of the end portion of the side of the pressure generating chamber 12 where the piezoelectric film 70 and an upper electrode film 80 are extended, the lower electrode film 60 is removed like a narrow groove in the direction in which the pressure generating chambers 12 are placed side by side, forming the removed portion 340, and the lower electrode film on the top of the peripheral wall of each pressure generating chamber 12 becomes a discontinuous lower electrode film 62 discontinuous with the lower electrode film 60 forming a part of the active part of piezoelectric element 320. The piezoelectric film 70 and the upper electrode film 80 are extended onto the discontinuous lower electrode film 62 to form an inactive part of piezoelectric element 330. The upper electrode film 80 and external wiring are connected in the proximity of the end portion (not shown).

According to such a configuration, advantages similar to those of the embodiments described above can also be provided. Further, in the embodiment, the remaining part 65 is provided in the area facing the partitions on both sides in the width direction of the pressure generating chamber 12 preferably under the above-described condition, so that the lower electrode film 60 removal area very lessens and if the piezoelectric film 70 is formed on the patterned lower electrode film 60, the film thickness of the piezoelectric film 70 becomes substantially even on the whole and the piezoelectric film 70 does not become locally thin.

Since the distance between the side at the end portion in the longitudinal direction of the piezoelectric film 70 and the part where the lower electrode film 60 extended to the top of the peripheral wall becomes wide is made comparatively narrow, the film thickness of the piezoelectric film 70 becomes even in the proximity of the end portion in the longitudinal direction of the pressure generating chamber 12. Thus, to use a nonselective etching method such as ion milling to etch the piezoelectric film 70 in the proximity of the end portion of the side of the pressure generating chamber 12 where the lower electrode film 60 is drawn, the lower electrode film 60 below the piezoelectric film 70 is not removed together and does not become thin. Therefore, the rigidity of the lower electrode film 60 in the proximity of the end portion of the pressure generating chamber 12 is not degraded and the durability is enhanced. The effect appears remarkably particularly if the piezoelectric film 70 is formed by a spin coat method such as the sol-gel method as described above; in addition, the piezoelectric film 70 may be formed by an MOD method (metal-organic decomposition method), etc., for example.

Figure 29:
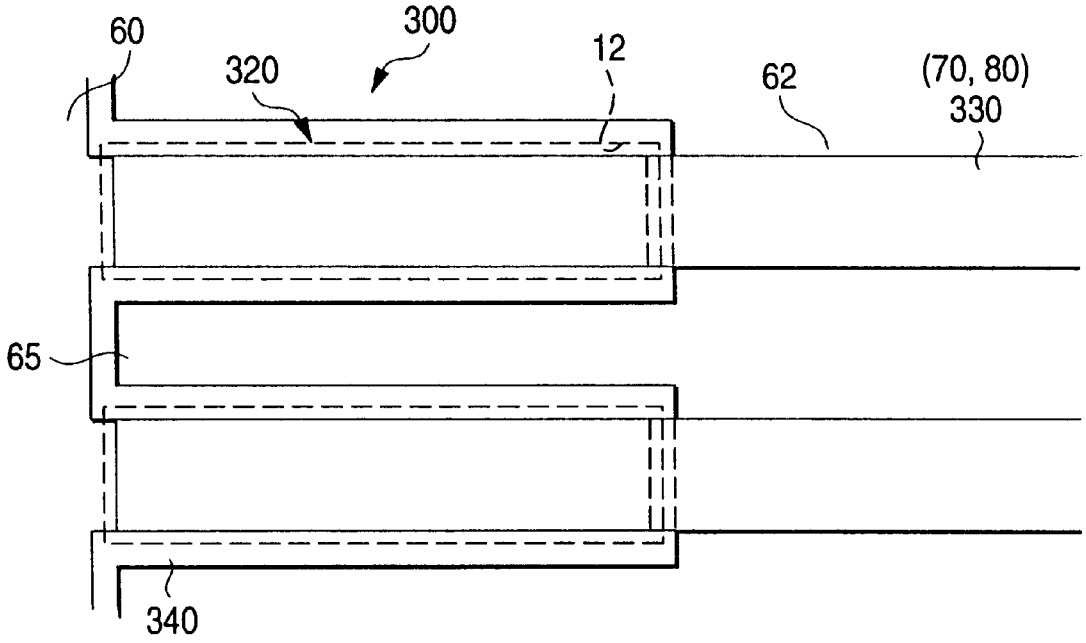
FIG. 29 is a plan view to show the main part of an ink jet recording head according to a fifteenth embodiment of the present invention.

FIG. 29 is a plan view of the main part of an ink jet recording head according to a fifteenth embodiment of the present invention.

The fifteenth embodiment is similar to the fourteenth embodiment except that a remaining part 65 provided on the top of a partition in the width direction of a pressure generating chamber 12 is provided continuously with a discontinuous lower electrode film 62 rather than a lower electrode film 60 forming a part of an active part of piezoelectric element 320.

Also according to such a configuration, a piezoelectric film 70 does not become thin and advantages similar to those of the fourteenth embodiment can be provided.

Figure 30A:
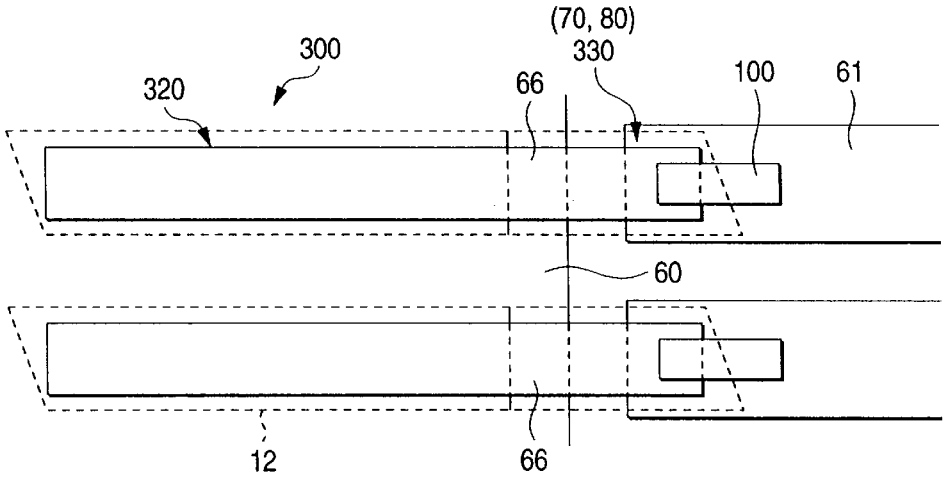
FIGS. 30A and 30B are a plan view and a sectional view to show the main part of an ink jet recording head according to a sixteenth embodiment of the present invention.
Figure 30B:
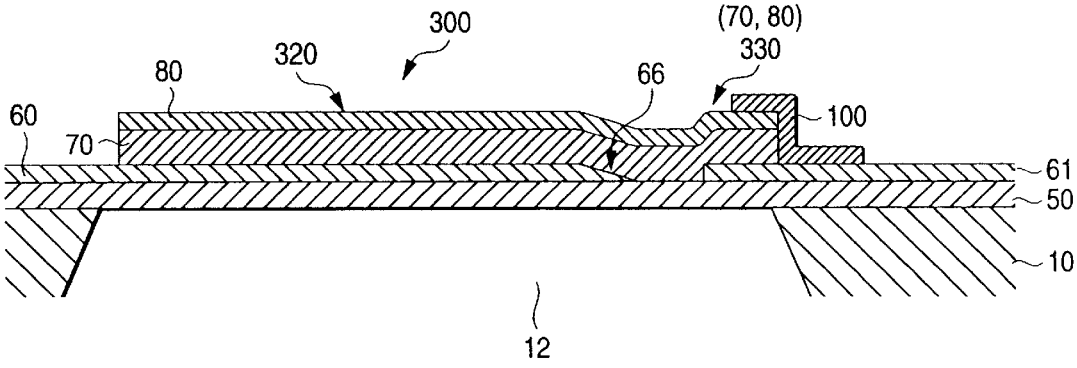

FIGS. 30A and 30B are a plan view and a sectional view in the longitudinal direction of the main part of an ink jet recording head according to a sixteenth embodiment of the present invention.

The sixteenth embodiment is similar to the first embodiment except that the film thickness of a lower electrode film 60 is gradually decreased toward the longitudinal end thereof is provided as a tapering portion 66 in the area which becomes the boundary of the active part of piezoelectric element 320 with an inactive part of piezoelectric element 330, as shown in FIG. 30. The form of the tapering portion 66 is not limited; for example, in the embodiment, the tapering portion 66 forms a slope where the film thickness of the lower electrode film 60 is gradually decreased continuously.

According to such a configuration, a piezoelectric film 70 is formed on the lower electrode film 60 containing the tapering portion 66 along the form of the lower electrode film 60 and the whole film thickness becomes substantially even. That is, the piezoelectric film 70 at the end portion of the lower electrode film 60 does not become thin and dielectric breakdown of the piezoelectric film 70 caused by concentration of an electric field, etc., in the proximity of the end portion of the active part of piezoelectric element 320 can be prevented.

Figure 31A:
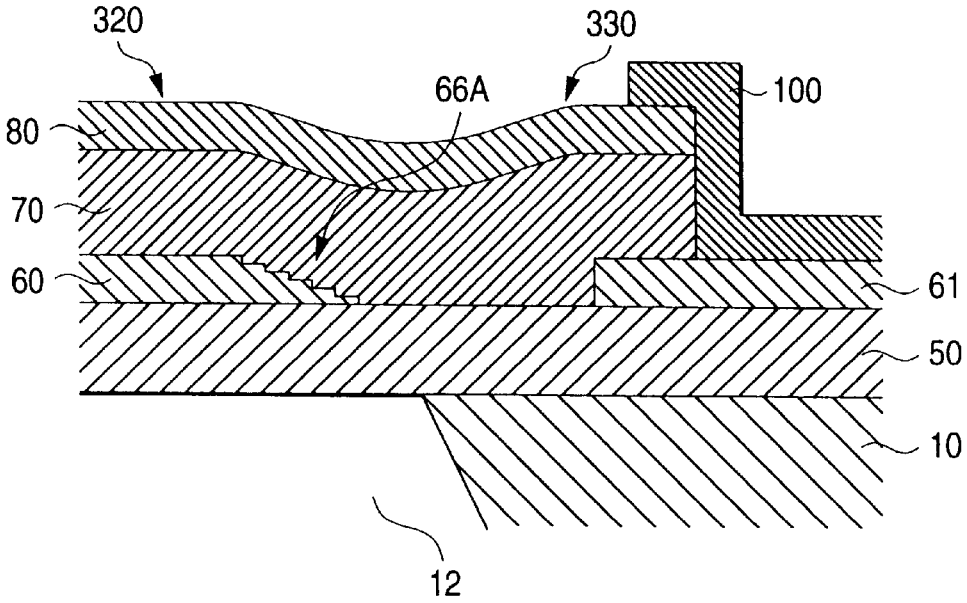
FIGS. 31A and 31B are sectional views to show modified examples of the ink jet recording head according to the sixteenth embodiment of the present invention.

In the embodiment, the tapering portion 66 is made a slope where the film thickness is gradually decreased continuously, but the scope of the present invention is not limited thereto. For example, as shown in FIG. 31A, a tapering portion 66A may be provided substantially stepwise in cross section with the film thickness decreased intermittently. The formation method of the tapering portion 66A is not limited either; for example, a resist is applied onto the lower electrode film 60 more than once and a resist film shaped like steps of substantially the same form as the tapering portion 66A is formed in the area of the lower electrode film 60 where the tapering portion 66A is to be formed, then the lower electrode film 60 is patterned, whereby the tapering portion 66A can be formed.

Figure 31B:
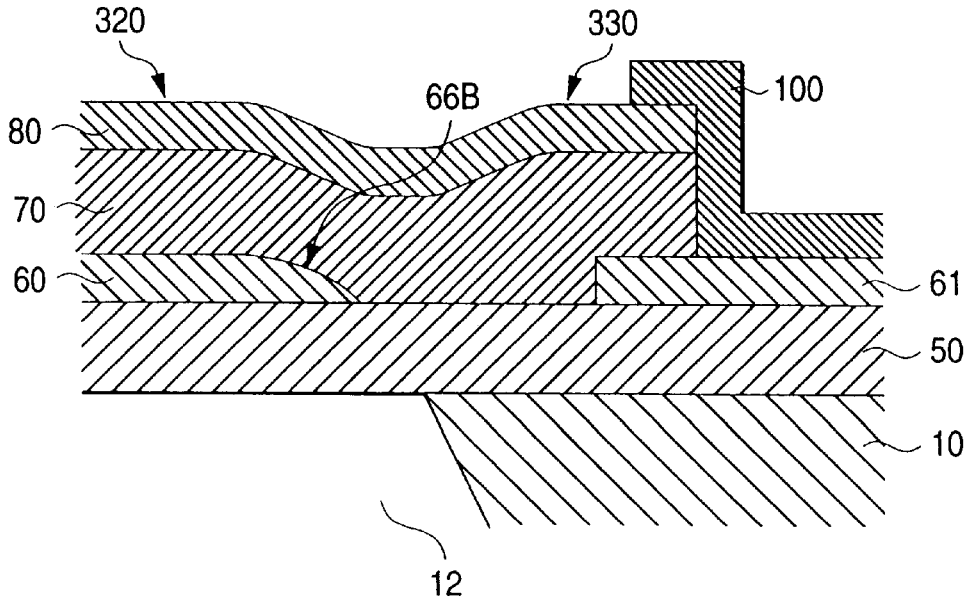

For example, as shown in FIG. 31B, a tapering portion 66B may be provided as a slanting curved surface in cross section. The formation method of the tapering portion 66B is not limited either; for example, the area on an elastic film 50 where the lower electrode film 60 is not formed and the area where the tapering portion 66B is to be formed are masked and the lower electrode film 60 is formed by so-called mask evaporation, whereby the tapering portion 66B is formed. That is, the lower electrode film 60 is also formed in a part of the mask area from a mask gap, providing the tapering portion 66B which is a slanting curved surface in cross section. Of course, as described above, a resist film of substantially the same form as the tapering portion 66B is formed on the lower electrode film 60, then the lower electrode film 60 is patterned, whereby the tapering portion 66B can be formed.

Figure 32A:
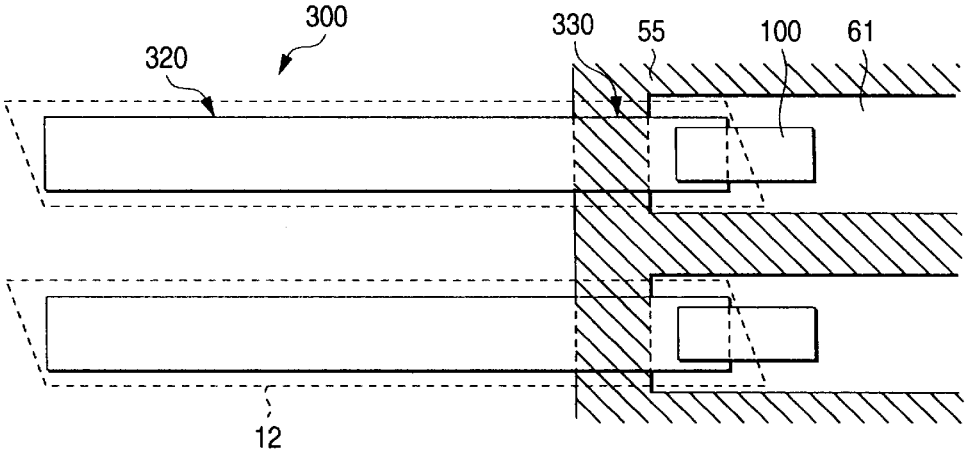
FIGS. 32A and 32B are a plan view and a sectional view to show the main part of an ink jet recording head according to a seventeenth embodiment of the present invention.
Figure 32B:
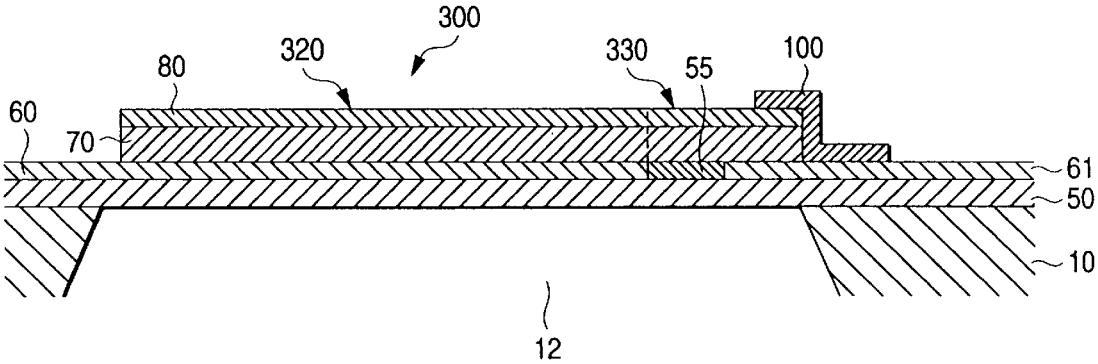

FIGS. 32A and 32B are a plan view and a sectional view in the longitudinal direction of the main part of an ink jet recording head according to a seventeenth embodiment of the present invention.

The seventeenth embodiment is an example wherein an insulating film made of an insulating material is provided on the outside in the longitudinal direction of a lower electrode film 60. That is, as shown in FIG. 32, a lower electrode film 60 and an active part of piezoelectric element 320 consisting of a piezoelectric film 70 and an upper electrode film 80 are formed on an elastic film 50 in the area facing each pressure generating chamber 12 and an insulating film 55 having substantially the same film thickness as the lower electrode film 60 is formed, for example, on the outside of the end portion of the lower electrode film 60 which becomes the boundary between the active part of piezoelectric element 320 and an inactive part of piezoelectric element 330. The material of the insulating film 55 is not limited; for example, it may be an insulating material different from that of the elastic film 50.

In the embodiment, after the lower electrode film 60 is patterned, the insulating film 55 is formed on the outside of one end portion of the lower electrode film 60 in the longitudinal direction thereof, and the piezoelectric film 70 and the upper electrode film 80 are formed and patterned on the insulating film 55, forming the active part of piezoelectric element 320 and the inactive part of piezoelectric element 330, whereby the piezoelectric film 70 does not become thin at the end portion of the lower electrode film 60, and dielectric breakdown of the piezoelectric film 70 caused by concentration of an electric field, etc., in the portion can be prevented. Also in such a configuration, similar advantages to those of the embodiments described above can be provided, of course.

Figure 33A:
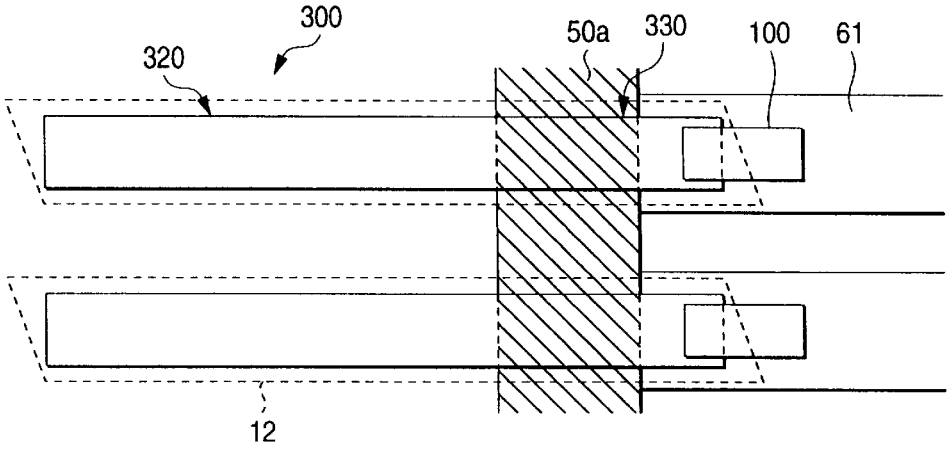
FIGS. 33A and 33B are a plan view and a sectional view to show the main part of an ink jet recording head according to an eighteenth embodiment of the present invention.
Figure 33B:
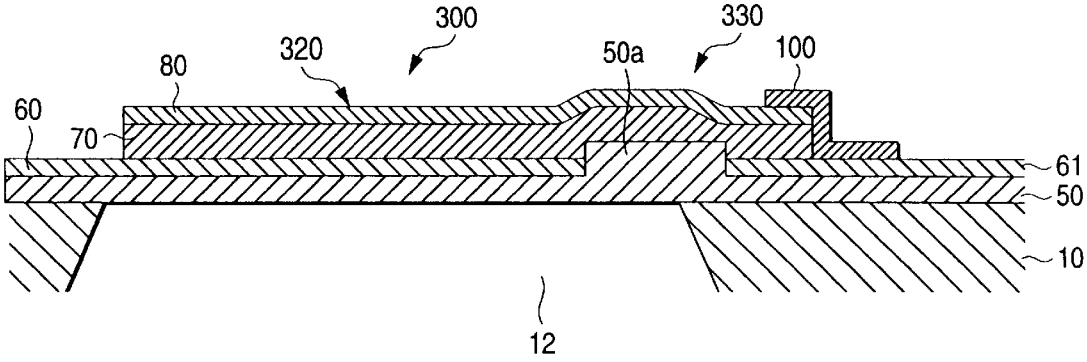

FIGS. 33A and 33B are a plan view and a sectional view in the longitudinal direction of the main part of an ink jet recording head according to an eighteenth embodiment of the present invention.

The eighteenth embodiment is similar to the seventeenth embodiment except that a thick portion 50*a* of an elastic film 50 thicker than any other portion (for example, in the embodiment, thicker than a lower electrode film 60) is provided on the outside of the end portion of the lower electrode film 60, which is the boundary between an active part of piezoelectric element 320 and an inactive part of piezoelectric element 330, in place of an insulating film 55, as shown in FIG. 33.

In the eighteenth embodiment, after the elastic film 50 is patterned to form the thick portion 50*a* at a predetermined position, a piezoelectric film 70 and an upper electrode film 80 are formed and patterned, thereby forming the active part of piezoelectric element 320 and the inactive part of piezoelectric element 330, whereby the piezoelectric film 70 in the area corresponding to the end portion of the lower electrode film 60 does not become thinner than any other portion, and dielectric breakdown of the piezoelectric film 70 caused by concentration of an electric field, etc., in the portion can be prevented. In such a configuration, similar advantages to those of the embodiments described above can also be provided.

Figure 34A:
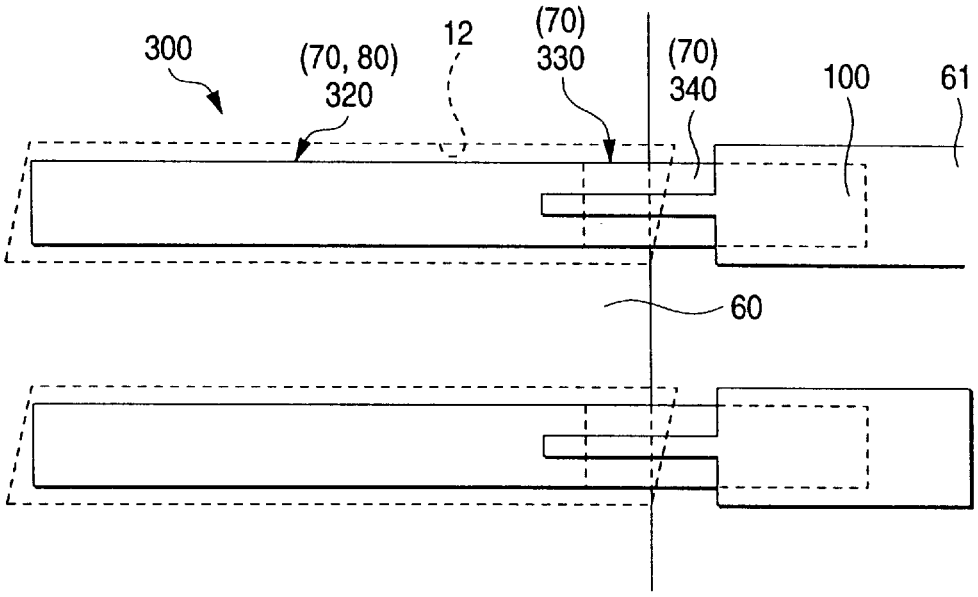
FIGS. 34A and 34B are a plan view and a sectional view to show the main part of an ink jet recording head according to a nineteenth embodiment of the present invention.
Figure 34B:
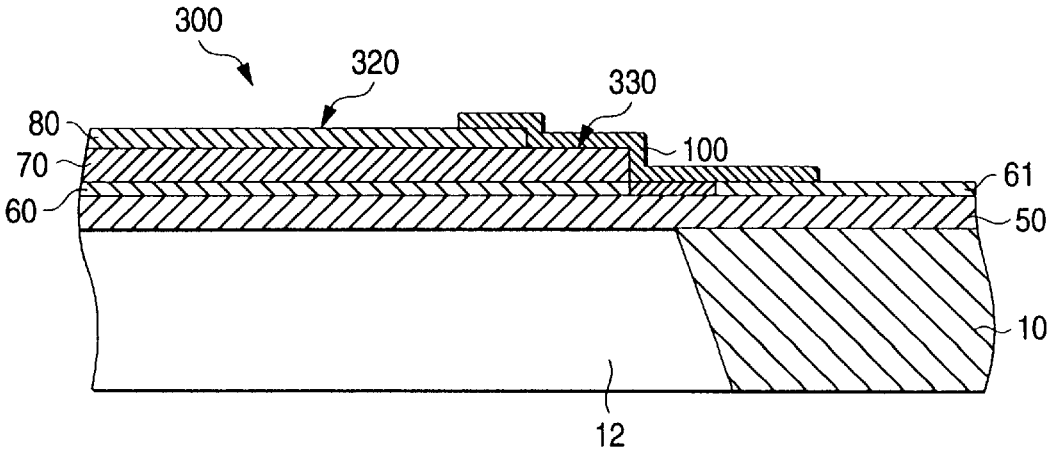

FIGS. 34A and 34B are a plan view and a sectional view in the longitudinal direction of the main part of an ink jet recording head according to a nineteenth embodiment of the present invention.

As shown in FIG. 34, the nineteenth embodiment is an example wherein the end portion of an upper electrode film 80 is formed inside from the end portion of a lower electrode film 60 and becomes the end portion of an active part of piezoelectric element 320. For example, in the embodiment, the end portion of a piezoelectric film 70 is at substantially the same position as the end portion of the lower electrode film 60 and the piezoelectric film 70 is also formed on the lower electrode film 60 projecting to the outside from the end portion of the upper electrode film 80, this portion forming an inactive part of piezoelectric element 330 not substantially driven.

In the embodiment, in a removed portion 340 where the lower electrode film 60 is removed between the lower electrode film 60 and a wiring lower electrode film 61, the piezoelectric film 70 is not removed and is left and the lower electrode film 60 and a lead electrode 100 are insulated from each other.

Thus, in the embodiment, on the outside of the end portion of the side of the active part of piezoelectric element 320 where the lead electrode 100 is drawn, the inactive part of piezoelectric element 330 is provided continuously, for example, by removing the upper electrode film 80, whereby the distance between the end portion of the upper electrode film 80, which is the end portion of the active part of piezoelectric element 320, and the end portion of the lower electrode film 60 can be made large. Thus, if a voltage is applied to the active part of piezoelectric element 320, the electric field strength at the end portion of the active part of piezoelectric element 320 does not grow and dielectric breakdown of the piezoelectric film 70, etc., can be prevented. Since the thickness of the piezoelectric film 70 of the active part of piezoelectric element 320 becomes even, the piezoelectric characteristic is improved. In such a configuration, similar advantages to those of the embodiments described above can also be provided.

The embodiments of the present invention have been described, but the basic configuration of the ink jet recording head is not limited to the configurations described above.

For example, in the above-described embodiments, the end portion of the lower electrode film 60 is the end portion of the active part of piezoelectric element 320 and the piezoelectric film 70 and the upper electrode film 80 on the lower electrode film 60 are extended to the outside of the end portion to provide the inactive part of piezoelectric element 330 for preventing destruction of the active part of piezoelectric element 320; at the opposite end portion, the piezoelectric film 70 and the upper electrode film 80 are patterned in the pressure generating chamber 12, thereby forming the end portion of the active part of piezoelectric element 320. There is a possibility that peeling, etc., of the piezoelectric film 70 and the upper electrode film 80 may occur at the end portion. However, for example, the end portion of the active part of piezoelectric element 320 may be fixed with an adhesive, etc., or may be covered with a discontinuous piezoelectric film discontinuous with the piezoelectric film 70 of the piezoelectric element 300 or the like, thereby protecting the end portion of the active part of piezoelectric element 320 for enhancing durability.

For example, in addition to the above-described sealing plate 20, the ink reservoir substrate 30 may be made of glass ceramic and further the thin wall 41 may be made of glass ceramic as a separate member; the material, structure, etc., can be changed as desired.

In the embodiments, the nozzle orifices are made in the side face of the channel substrate 10, but may be formed projecting in a direction perpendicular to the face.

Figure 35:
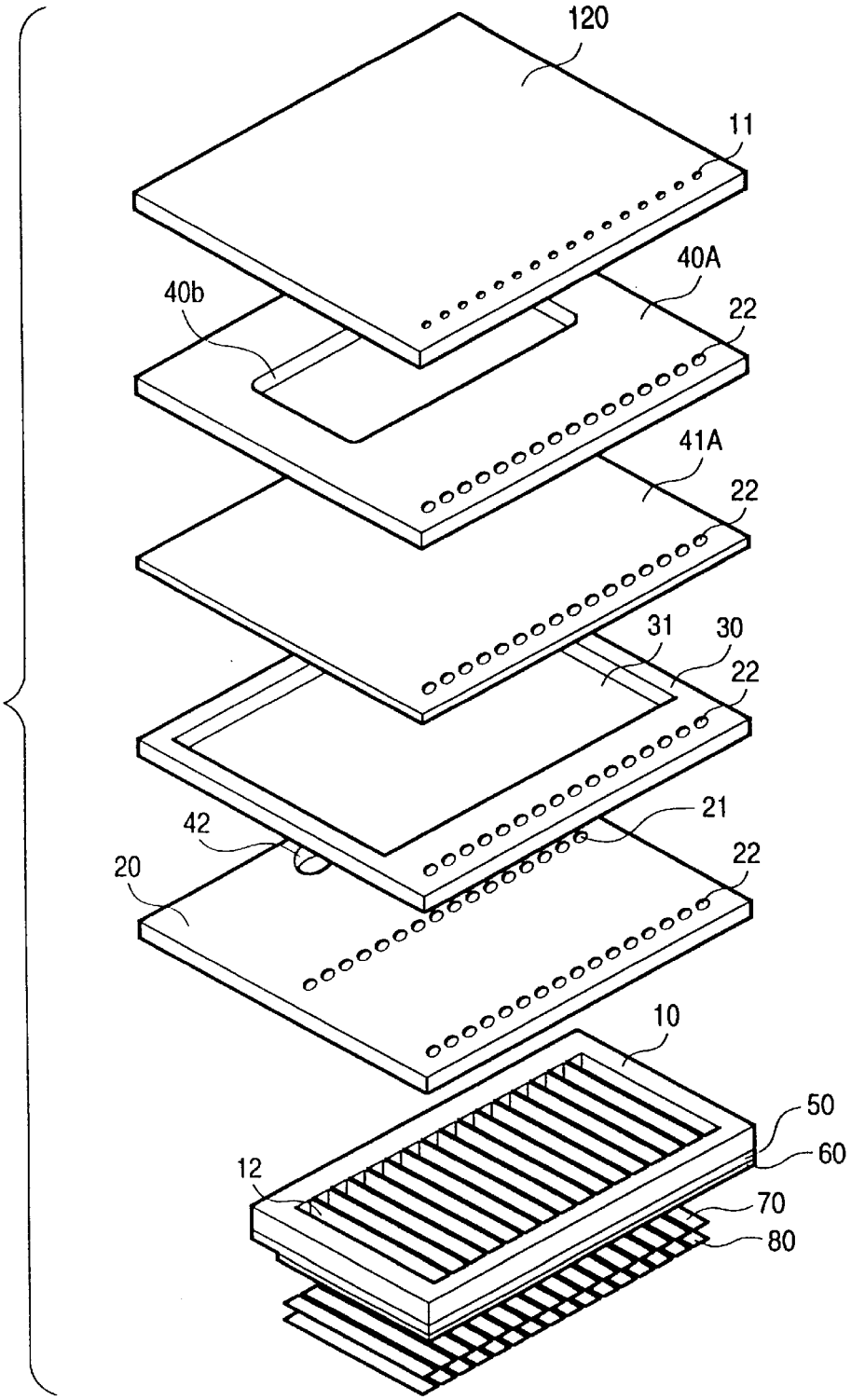
FIG. 35 is an exploded perspective view to show an ink jet recording head according to another embodiment of the present invention.
Figure 36:
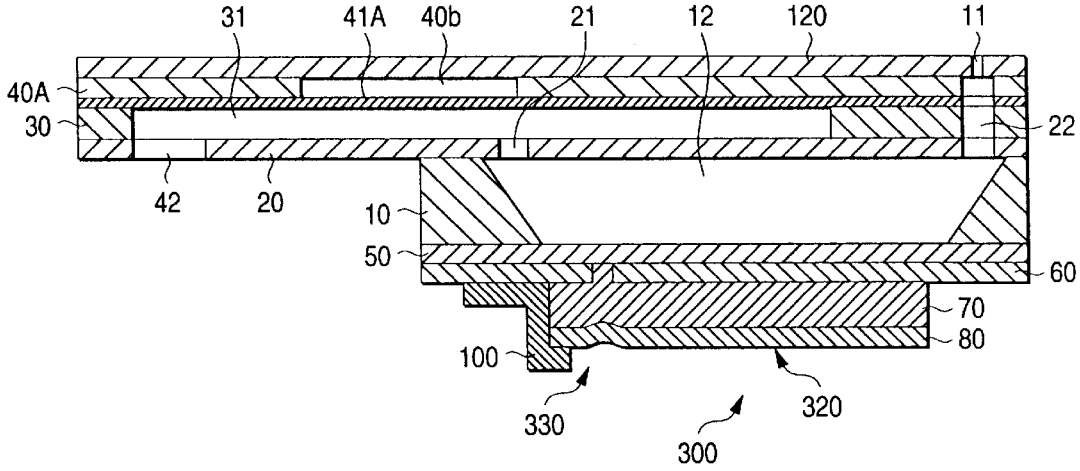
FIG. 36 is a sectional view to show the ink jet recording head shown in FIG. 35.

FIG. 35 is an exploded perspective view of an embodiment of an ink jet recording head having the configuration and FIG. 36 is a sectional view to show a flow passage in the ink jet recording head. In the embodiment, nozzle orifices 11 are made in a nozzle plate 120 opposed to piezoelectric vibrator and nozzle communication ports 22 for allowing the nozzle orifices 11 and pressure generating chambers 12 to communicate with each other are placed so as to penetrate a sealing plate 20, an ink reservoir substrate 30, a thin plate 41A, and an ink reservoir side plate 40A.

The embodiment is basically similar to the above-described embodiments except that the thin plate 41A and ink reservoir side plate 40A are separate members and except that an opening 40*b* is made in the ink reservoir side plate 40A. Parts identical with those previously described with reference to the accompanying drawings are denoted by the same reference numerals in FIGS. 35 and 36 are will not be discussed again.

Also in the embodiment, as in the above-described embodiments, a voltage can be applied to active part of piezoelectric element not via a contact hole, so that the displacement efficiency of elastic film can be improved.

The above-described embodiments can be combined appropriately, thereby providing more advantages, needless to say.

In the above-described embodiments, ink jet recording heads of thin film type that can be manufactured by applying the film formation and lithography process are taken as examples, but the scope of the present invention is not limited thereto. For example, the present invention can be adopted for ink jet recording heads of various structures such as a structure wherein substrates are deposited on each other for forming pressure generating chambers, a structure wherein a piezoelectric film is formed by putting a green sheet or executing screen print, etc., and a structure wherein a piezoelectric film is formed by crystal growth such as a water and heat method.

Thus, the present invention can be applied to ink jet recording heads of various structures without departing from the spirit and the scope of the present invention.

Figure 37:
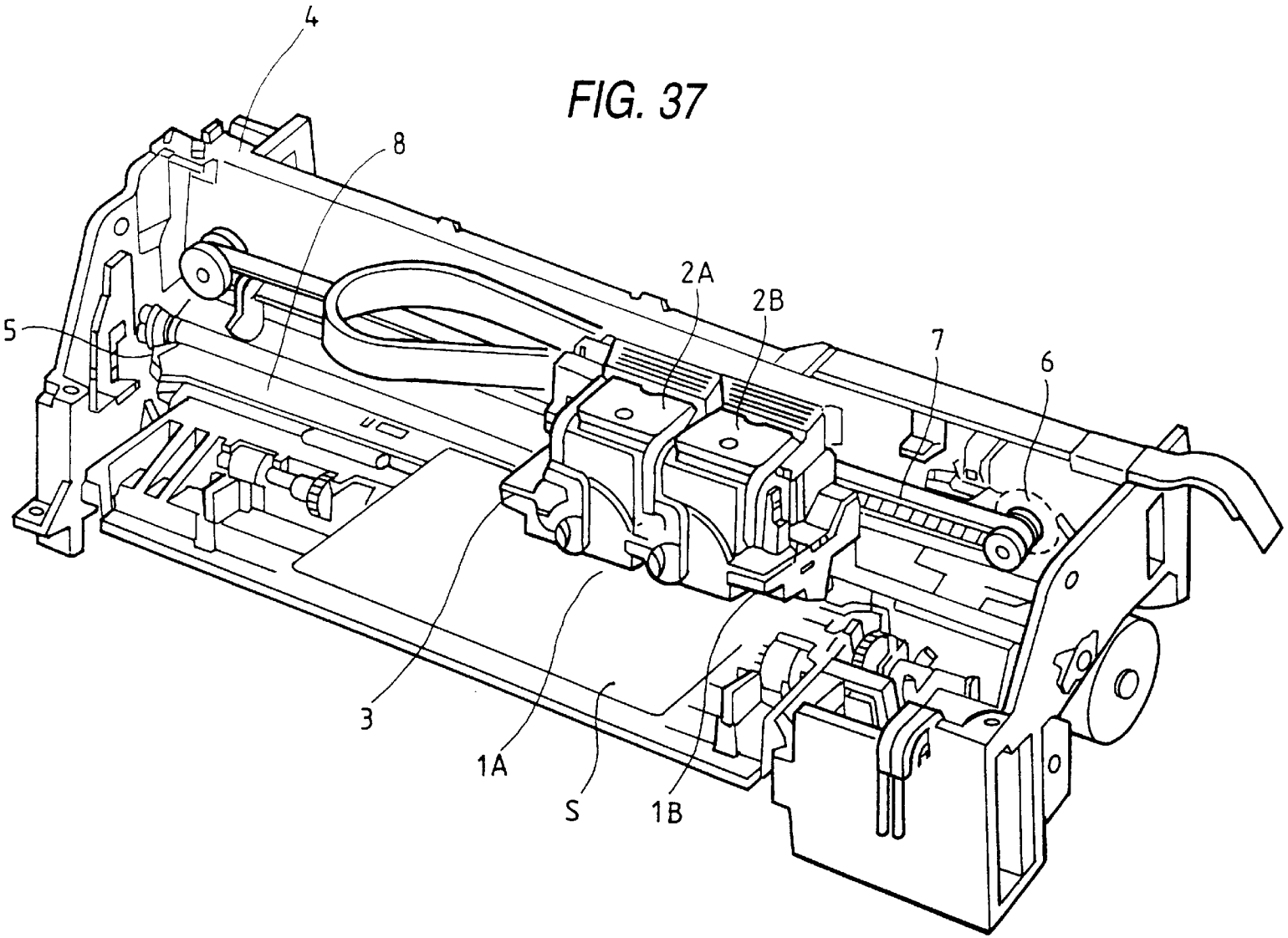
FIG. 37 is a schematic diagram to show an ink jet recording apparatus according to one embodiment of the present invention.

Each of the ink jet recording heads of the embodiments forms a part of a recording head unit comprising an ink flow passage communicating with an ink cartridge, etc., and is installed in an ink jet recording apparatus. FIG. 37 is a schematic diagram to show an example of the ink jet recording apparatus.

As shown in FIG. 37, cartridges 2A and 2B forming ink supply means are detachably placed in recording head units 1A and 1B each having an ink jet recording head, and a carriage 3 on which the recording head units 1A and 1B are mounted is placed axially movably on a carriage shaft 5 attached to a recorder main body 4. The recording head units 1A and 1B jet a black ink composite and a color ink composite respectively, for example.

The driving force of a drive motor 6 is transmitted to the carriage 3 via a plurality of gears and a timing belt (not shown), whereby the carriage 3 on which the recording head units 1A and 1B are mounted is moved along the carriage shaft 5. On the other hand, the recorder main body 4 is provided with a platen 8 along the carriage 3. The platen 8 can be rotated by the drive force of a paper feed motor (not shown) and a recording sheet S of a recording medium such as paper fed by a paper feed roller, etc., is wrapped around the platen 8 and is transported.

As described above, according to the present invention, the inactive part of piezoelectric element including the piezoelectric film, but is not substantially driven is provided continuously from the active part of piezoelectric element, whereby a voltage can be applied to the active part of piezoelectric element without forming a contact hole and the active part of piezoelectric element can be provided in the area facing the pressure generating chamber, so that the displacement characteristic and reliability can be enhanced.

What is claimed is:

1. An ink jet recording head comprising:

pressure generating chambers communicating with associated nozzle orifices; and piezoelectric elements provided in a one-to-one correspondence with the pressure generating chambers, each of the piezoelectric elements comprising a lower electrode provided in an area corresponding to the pressure generating chamber via an insulating layer, a piezoelectric layer provided on the lower electrode, and an upper electrode provided on the piezoelectric layer, an active area of the piezoelectric elements provided in an area facing the pressure generating chamber, and a non-driven inactive area of the piezoelectric elements adjacent to said active area, wherein an outline of the lower electrode defines a border between the active area and the inactive area.

2. The ink jet recording head as set forth in claim 1, wherein crystal directions of the piezoelectric layer are oriented.

3. The ink jet recording head as set forth in claim 2, wherein the piezoelectric layer has a columnar crystalline structure.

4. The ink jet recording head as set forth in claim 1, wherein the inactive area is extended from the inside of an area facing the pressure generating chamber to the outside of an area facing the pressure generating chamber.

5. The ink jet recording head as set forth in claim 1, wherein either the upper electrode or a lead electrode connected thereto is extended to the top of a peripheral wall of the pressure generating chamber through the inactive area.

6. The ink jet recording head as set forth in claim 5, wherein the width of the removed lower electrode below the inactive area is narrower than the width of the pressure generating chamber.

7. The ink jet recording head as set forth in claim 5, wherein a discontinuous lower electrode discontinuous with the lower electrode is provided below the piezoelectric layer in the area facing the boundary between the pressure generating chamber and the peripheral wall thereof.

8. The ink jet recording head as set forth in claim 7, wherein the discontinuous lower electrode is provided covering at least a margin of the pressure generating chamber.

9. The ink jet recording head as set forth in claim 7, wherein the discontinuous lower electrode is made discontinuous with the lower electrode by removing a lower electrode in the proximity of the end portion of the lower electrode in the longitudinal direction of the pressure generating chamber so as to extend in a width direction of the pressure generating chamber.

10. The ink jet recording head as set forth in claim 7, wherein the discontinuous lower electrode is not electrically connected to any parts.

11. The ink jet recording head as set forth in claim 7, wherein the discontinuous lower electrode is connected to a resistor so that time constant of the lower electrode becomes larger than that of a drive pulse for the piezoelectric element.

12. The ink jet recording head as set forth in claim 7, wherein a wiring lower electrode is provided for each piezoelectric element on the peripheral wall on which the discontinuous lower electrode is provided discretely from the discontinuous lower electrode.

13. The ink jet recording head as set forth in claim 7, wherein the discontinuous lower electrode is separated for each active area in the width direction of the pressure generating chamber and each is connected to either the upper electrode of the corresponding active area or at lead electrode connected to the top of the upper electrode.

14. The ink jet recording head as set forth in claim 13, wherein each discontinuous lower electrode and the lower electrode have a spacing to such an extent that they can be insulated from each other.

15. The ink jet recording head as set forth in claim 13, wherein an intermediate electrode having no connection with any parts is provided between the juxtaposed discontinuous lower electrodes.

16. The ink jet recording head as set forth in claim 7, wherein the piezoelectric layer is left at least in a part of the removed portion of the lower electrode situated in other than the area corresponding to the piezoelectric element.

17. The ink jet recording head as set forth in claim 5, wherein a second insulating layer is provided on the outside of the end portion of the lower electrode.

18. The ink jet recording head as set forth in claim 17, wherein the second insulating layer has substantially the same film thickness as the lower electrode.

19. The ink jet recording head as set forth in claim 17, wherein the second insulating layer is made of an insulating material different from that of the insulating layer.

20. The ink jet recording head as set forth in claim 5, wherein the insulating layer includes a thick portion situated on the outside of the end portion of the lower electrode.

21. The ink jet recording head as set forth in claim 20, wherein the thick portion has substantially the same thickness as the lower electrode.

22. The ink jet recording head as set forth in claim 5, wherein a tapering portion where film thickness of the lower electrode is gradually decreased toward the outside of the active part is provided at the end portion of the lower electrode.

23. The ink jet recording head as set forth in claim 22, wherein the tapering portion forms a slope where the film thickness of the lower electrode is gradually decreased.

24. The ink jet recording head as set forth in claim 22, wherein the tapering portion is a part where the film thickness of the lower electrode is gradually decreased stepwise.

25. The ink jet recording head as set forth in claim 22, wherein the tapering portion forms a slanting curved surface where the film thickness of the lower electrode is gradually decreased continuously.

26. The ink jet recording head as set forth in claim 22, wherein the piezoelectric layer formed on the tapering portion is thicker than any other portion.

27. The ink jet recording head as set forth in claim 5, wherein both longitudinal end portions of the active area are formed into a similar structure.

28. The ink jet recording head as set forth in claim 5, wherein end portions of the piezoelectric layer and the upper electrode define a distal end of the active area which is opposed end to the end continued to the inactive area, and wherein the distal end is covered with a discontinuous piezoelectric layer discontinuous with the piezoelectric layer.

29. The ink jet recording head as set forth in claim 5, wherein end portions of the piezoelectric layer and the upper electrode define a distal end of the active area which is opposed end to the end continued to the inactive area, and wherein the distal end is fixed with an adhesive.

30. The ink jet recording head as set forth in claim 1, wherein an end portion of the upper electrode is positioned inside from an end portion of the lower electrode to be an end portion of the active area, and wherein the piezoelectric layer is provided on the lower electrode projecting to the outside from the end portion of the upper electrode, forming the inactive area, and is also provided outside the end portion of the lower electrode.

31. The ink jet recording head as set forth in claim 1, wherein the inactive area is provided continuously at one end portion in a longitudinal direction of the active area.

32. The ink jet recording head as set forth in claim 31, wherein the width of the inactive area at least in the proximity of a portion crossing the boundary between an end portion and the peripheral wall of the pressure generating chamber is narrower than the width of the inactive area.

33. The ink jet recording head as set forth in claim 31, wherein the width of the inactive area at least in the proximity of a portion crossing the boundary between an end portion and the peripheral wall of the pressure generating chamber is wider than the width of the pressure generating chamber.

34. The ink jet recording head as set forth in claim 1, wherein a displacement suppression layer for suppressing displacement of the active area is provided in an area facing the boundary between the active area and the inactive area.

35. The ink jet recording head as set forth in claim 1, wherein the lower electrode is provided continuously to the area facing partitions on both sides in the width direction of the pressure generating chamber and adjacent pressure generating chambers.

36. The ink jet recording head as set forth in claim 1, wherein the inactive area is provided in one longitudinal end portion of the piezoelectric element, and wherein the lower electrode is provided so that both end portions in the width direction of the lower electrode are positioned in the pressure generating chamber together with both end portions in the width direction of the piezoelectric layer, and is extended from the other longitudinal end portion of the piezoelectric element to the top of the peripheral wall of the pressure generating chamber.

37. The ink jet recording head as set forth in claim 1, wherein the area facing the pressure generating chamber other than the inactive area is covered with the lower electrode.

38. The ink jet recording head as set forth in claim 37, wherein the inactive area is extended from a substantially central part of the pressure generating chamber in the longitudinal direction thereof on one peripheral wall in the width direction of the pressure generating chamber.

39. The ink jet recording head as set forth in claim 37, wherein the removed portion of the lower electrode below the inactive area is shaped substantially into a circle.

40. The ink jet recording head as set forth in claim 37, wherein the direction in which a margin of the upper electrode crosses from the top of the lower electrode to the top of the lower electrode removed portion is different from the direction in which the upper electrode is extended to the top of the peripheral wall of the pressure generating chamber.

41. The ink jet recording head as set forth in claim 1, wherein the width of the lower electrode in a portion facing the boundary of the active area and the inactive area is narrower than any other portion.

42. The ink jet recording head as set forth in claim 41, wherein at least the distal end of the narrowed portion of the lower electrode is narrower than the piezoelectric layer and the upper electrode of the inactive area.

43. The inkjet recording head as set forth in claim 41, wherein the whole of the narrowed portion of the lower electrode is narrower than the piezoelectric layer and the upper electrode of the inactive area.

44. The ink jet recording head as set forth in claim 41 wherein the width of the narrowed portion of the lower electrode is wider than that of the piezoelectric layer and the upper electrode of the inactive area, and wherein the distance between an end face in the width direction of the narrowed portion and an end face in the width direction of the upper electrode is about 10 $\mu$m or less.

45. The ink jet recording head as set forth in claim 1, wherein a remaining part made of the same layer as the lower electrode is provided on the partition on both sides of the pressure generating chamber in the width direction thereof.

46. The ink jet recording head as set forth in claim 45, wherein outside the end portion of the lower electrode of the active area, a discontinuous lower electrode discontinuous with the lower electrode, and wherein the remaining part is extended continuously from the discontinuous lower electrode.

47. The ink jet recording head as set forth in claim 45 wherein the remaining part is provided continuously with the lower electrode forming a part of the piezoelectric element.

48. The ink jet recording head as set forth in claim 45, wherein spacing between an end face in the width direction of the lower electrode and an end face in the width direction of the remaining part is wider than the thickness of the piezoelectric layer and is narrower than the width of the lower electrode.

49. The ink jet recording head as set forth in claim, 45 wherein an longitudinal end portion of the piezoelectric layer is situated in the proximity of the end portion of the pressure generating chamber the side of which the lower electrode is extended to the top of the peripheral wall, and wherein the distance from that end portion to a part where the lower electrode extended to the outside becomes wider is wider than the thickness of the piezoelectric layer and is narrower than the width of the lower electrode.

50. The ink jet recording head as set forth in claim 45, wherein the remaining part has a width which is 50% or more of the width of the partition between the adjacent pressure generating chambers.

51. The ink jet recording head as set forth in claim 45, wherein the lower electrode and the remaining part are formed in an area having a width of 50% or more of the area corresponding to the pressure generating chambers placed side by side and the partitions on both sides of the pressure generating chambers in the width direction thereof.

52. The ink jet recording head as set forth in claim 45, wherein the lower electrode and the remaining part are formed in an area of 50% or more of all area of the channel substrate.

53. The ink jet recording head as set forth in claim 1, wherein the crystalline structure of the piezoelectric layer on the lower electrode is the same as that on the insulating layer.

54. The ink jet recording head as set forth in claim 53, wherein crystal seeds becoming nuclei of crystal of the piezoelectric layer are formed on a surface of the insulating layer.

55. The ink jet recording head as set forth in claim 54 wherein the crystal seeds are formed like islands.

56. The ink jet recording head as set forth in claim 1, wherein the pressure generating chambers are formed in a silicon monocrystalline substrate by anisotropic etching, and wherein the lower electrode, piezoelectric, and upper electrode layers are formed by film formation and lithography method.

57. An ink jet recording apparatus comprising an ink jet recording head as set forth in any of claims 1 to 56.

* * * * *